US008069617B2

(12) United States Patent
Wootton

(10) Patent No.: US 8,069,617 B2
(45) Date of Patent: Dec. 6, 2011

(54) DEBRIS DEFLECTION DEVICES

(76) Inventor: Thomas A. Wootton, Richland, MI (US)

( * ) Notice: Subject to any disclaimer, the term of this patent is extended or adjusted under 35 U.S.C. 154(b) by 126 days.

(21) Appl. No.: 12/468,451

(22) Filed: May 19, 2009

(65) Prior Publication Data

US 2009/0288349 A1 Nov. 26, 2009

Related U.S. Application Data

(60) Provisional application No. 61/054,617, filed on May 20, 2008, provisional application No. 61/156,271, filed on Feb. 27, 2009.

(51) Int. Cl.
*E04D 13/00* (2006.01)

(52) U.S. Cl. ..... 52/12; 210/474

(58) Field of Classification Search ..... 52/11–15; 210/474

See application file for complete search history.

(56) References Cited

U.S. PATENT DOCUMENTS

| | | | |
|---|---|---|---|
| 2,271,081 | A | 1/1942 | Layton |
| 2,288,121 | A | 6/1942 | Haddon |
| 2,583,422 | A | 1/1952 | Goetz |
| 2,672,832 | A | 3/1954 | Goetz |
| 2,847,949 | A | 8/1958 | Pond |
| 2,873,700 | A | 2/1959 | Heier |
| 4,036,761 | A | 7/1977 | Rankin |
| 4,286,418 | A | 9/1981 | Snyder |
| 4,308,696 | A | 1/1982 | Schroeder |
| 4,351,134 | A | 9/1982 | Clarkson |
| 4,404,775 | A | 9/1983 | Demartini et al. |
| 4,411,109 | A | 10/1983 | Struben et al. |
| 4,435,925 | A | 3/1984 | Jefferys |
| 4,445,301 | A | 5/1984 | Tanski |
| 4,447,994 | A | 5/1984 | Garneau |
| 4,455,791 | A | 6/1984 | Elko |
| 4,493,588 | A | 1/1985 | Duffy |
| 4,497,146 | A | 2/1985 | Demartini et al. |
| 4,551,956 | A | 11/1985 | Axford |
| 4,571,896 | A | 2/1986 | Condie |
| 4,592,174 | A | 6/1986 | Hileman |
| 4,604,837 | A | 8/1986 | Beam |
| 4,631,875 | A | 12/1986 | Olson |
| 4,646,488 | A | 3/1987 | Burns |
| 4,664,439 | A | 5/1987 | Schaetzler et al. |
| 4,709,959 | A | 12/1987 | Paerisch et al. |
| 4,745,710 | A | 5/1988 | Davis |

(Continued)

FOREIGN PATENT DOCUMENTS

EP 0903449 A2 3/1999

(Continued)

OTHER PUBLICATIONS

Preferred Distributing, Inc.; "How it Works" Section of Website and Photographs of the LeafFilter Gutter Protection Product; www.leaffilter.com; downloaded on Aug. 21, 2009, Plainwell, MI.

(Continued)

*Primary Examiner* — Eileen D Lillis
*Assistant Examiner* — Chi Nguyen
(74) *Attorney, Agent, or Firm* — Thomas A. Wootton; Honigman Miller Schwartz & Cohn

(57) ABSTRACT

This invention related to the field of drains and rain gutters typically attached to a house or commercial building. This invention describes gutter inserts that block, or deflect vegetation and other debris from entering rain gutters.

8 Claims, 6 Drawing Sheets

U.S. PATENT DOCUMENTS 4,750,300 A 6/1988 Winger, Jr.
4,757,649 A 7/1988 Vahldieck
4,796,390 A 1/1989 Demartini et al.
4,858,396 A 8/1989 Rose
4,866,890 A 9/1989 Otto
4,876,827 A 10/1989 Williams
4,883,311 A 11/1989 Kohlpaintner et al.
4,937,986 A 7/1990 Way, Sr.
4,949,514 A 8/1990 Weller
5,010,696 A 4/1991 Knittel
5,016,404 A 5/1991 Briggs
5,099,620 A 3/1992 Carey
5,107,635 A 4/1992 Carpenter
5,181,350 A 1/1993 Meckstroth
5,189,849 A 3/1993 Collins
5,216,851 A 6/1993 Kuhns
5,251,410 A 10/1993 Carey
5,261,195 A 11/1993 Buckenmaier et al.
5,305,562 A 4/1994 Sapia
5,339,575 A 8/1994 Kuhns
5,375,379 A 12/1994 Meckstroth
5,383,310 A 1/1995 Sapia
5,406,754 A 4/1995 Cosby
5,459,965 A 10/1995 Meckstroth
5,471,798 A 12/1995 Kuhns
5,557,891 A 9/1996 Albracht
5,617,678 A 4/1997 Morandin
5,619,825 A 4/1997 Leroney et al.
5,640,809 A 6/1997 Iannelli
5,640,810 A 6/1997 Pietersen
5,660,001 A 8/1997 Albracht
5,729,931 A 3/1998 Wade
5,740,633 A * 4/1998 Champagne ..... 52/11
5,755,061 A 5/1998 Chen
5,802,777 A 9/1998 Sato
5,845,435 A * 12/1998 Knudson ..... 52/11
5,875,590 A 3/1999 Udelle
D410,530 S 6/1999 Turner
5,916,092 A 6/1999 Chen
5,956,904 A 9/1999 Gentry
D416,079 S 11/1999 Hallett, II
6,009,672 A 1/2000 Kuhns
6,067,755 A 5/2000 Maanum
6,073,398 A 6/2000 Williams
6,098,345 A 8/2000 Demartini et al.
6,134,843 A 10/2000 Tregear
6,205,715 B1 3/2001 Rex, Jr.
6,256,933 B1 7/2001 Kuhns
6,412,228 B1 7/2002 Meckstroth
6,412,229 B2 7/2002 Kuhns
D470,926 S 2/2003 Knight
6,536,165 B2 3/2003 Pilcher
6,598,352 B2 7/2003 Higginbotham
6,658,796 B1 * 12/2003 Higgins ..... 52/11
6,672,012 B2 1/2004 Bahroos et al.
6,681,527 B2 * 1/2004 Baker ..... 52/12
6,688,045 B1 2/2004 Pilcher
6,732,477 B1 5/2004 Richard et al.
6,735,907 B2 5/2004 Stevens
D492,394 S 6/2004 Bullinger
6,745,516 B2 6/2004 Beyers
6,883,760 B2 4/2005 Seise, Jr.
D505,716 S 5/2005 Kavanagh
6,932,911 B1 * 8/2005 Groth et al. ..... 52/12
6,942,419 B2 9/2005 Knak et al.
6,944,991 B2 9/2005 Kim
6,993,870 B2 2/2006 McDonald et al.
6,993,871 B2 2/2006 Richard et al.
7,117,643 B2 10/2006 Brown
7,174,688 B2 2/2007 Higginbotham
7,191,564 B2 3/2007 Higginbotham
7,208,081 B2 * 4/2007 Jones ..... 210/162
D558,309 S 12/2007 Gregg
7,303,687 B2 12/2007 Groth et al.
7,310,912 B2 12/2007 Lenney
7,340,863 B1 3/2008 Dressler
7,347,027 B2 3/2008 McDonald et al.
7,395,632 B2 7/2008 Filippi
7,506,476 B2 3/2009 McDonald et al.
7,752,811 B1 * 7/2010 Pavlansky ..... 52/12
2001/0017008 A1 8/2001 Kuhns
2001/0022052 A1 9/2001 Pilcher
2002/0152692 A1 10/2002 Bahroos et al.
2002/0166290 A1 11/2002 Bergeron
2003/0009951 A1 1/2003 Bergeron
2003/0089046 A1 5/2003 Stevens
2004/0244303 A1 12/2004 Seise
2004/0250478 A1 12/2004 McDonald et al.
2004/0255522 A1 * 12/2004 Knudson et al. ..... 52/11
2005/0000167 A1 1/2005 Richard et al.
2005/0108951 A1 5/2005 McDonald et al.
2005/0115158 A1 6/2005 Brown
2005/0115190 A1 6/2005 Brown
2005/0138866 A1 6/2005 Kim
2005/0145560 A1 7/2005 Jones
2005/0166465 A1 8/2005 Banks et al.
2005/0166466 A1 8/2005 Cobb
2005/0172565 A1 8/2005 Riley et al.
2005/0172566 A1 8/2005 McDonald et al.
2005/0247611 A1 * 11/2005 Groth et al. ..... 210/162
2006/0037253 A1 2/2006 Mozeika
2006/0075689 A1 4/2006 Hawash
2006/0101722 A1 5/2006 Ealer, Sr.
2006/0117672 A1 6/2006 Kurple et al.
2006/0123710 A1 6/2006 Lenney et al.
2006/0201069 A1 9/2006 Richard et al.
2006/0225367 A1 10/2006 Stagni
2006/0230687 A1 10/2006 Ealer, Sr.
2006/0272223 A1 12/2006 McDonald et al.
2007/0094940 A1 5/2007 Pijanowski
2007/0119104 A1 5/2007 Pijanowski
2007/0175106 A1 8/2007 Rotter
2007/0199249 A1 8/2007 Beck et al.
2007/0266753 A1 11/2007 Kuhns
2008/0000169 A1 1/2008 Handley
2008/0016787 A1 1/2008 Marriner
2008/0120921 A1 5/2008 McDonald et al.
2008/0141595 A1 6/2008 Lawler
2008/0190039 A1 8/2008 Brochu
2008/0276546 A1 11/2008 Etheredge
2009/0000210 A1 1/2009 Barnett
2009/0019786 A1 1/2009 Bachman
2009/0031638 A1 2/2009 Iannelli
2009/0090067 A1 4/2009 Demartini
2009/0178366 A1 7/2009 Konkey
2009/0188173 A1 7/2009 Ealer, Sr.

FOREIGN PATENT DOCUMENTS

WO WO 2009/142733 A3 11/2009

OTHER PUBLICATIONS

GutterFilter, Inc. "Comparisions" Section of GutterFilter Web Site and Photographs of the GutterFilter Gutter Protection Product; www.gutterfilter.com; downloaded on Aug. 21, 2009.

GutterSentry, Inc. "Faq's" Section of the GutterSentry Web Site and Photographs of the GutterSentry Protection Product; www.guttersentry.com; downloaded on Aug. 21, 2009.

Southeastern Metals Manufacturing Company, Inc. "How it works" Section of GutterHelmet Web Site and Photographs of the GutterHelmet Protection Product; www.gutterhelmet.com, downloaded on Aug. 24, 2009.

Gutter Topper LTD. "How it Works" Section of Website and Photographs of the GutterTopper Gutter Protection System; www.guttertopper.com; downloaded on Aug. 24, 2009, Amelia, OH.

ERAN Industries, Inc. "How Leafproof Works" Section of the Leafproof Web Site and Photographs of the Leafproof Protection System; www.leafproof.com; downloaded on Aug. 24, 2009.

R.K.Industries. "How Waterloov Works" on www.waterloov.com; U.S. Patent Nos. 4,411,110; #5,216,851; Des #382,944; #5,339,575; #6,009,672; #6,256,933; #6.412,229, downloaded on Aug. 24, 2009.

International Search Report published Feb. 18, 2010.

* cited by examiner

DEBRIS DEFLECTION DEVICES

CROSS-REFERENCE TO RELATED APPLICATIONS

This patent application claims the benefit of U.S. Provisional Patent Application Ser. No. 61/054,617, filed on 20 May 2008 and U.S. Provisional Patent Application Ser. No. 61/156,271, filed on 27 Feb. 2009, which are hereby incorporated in their entirety by reference.

FIELD OF THE INVENTION

This invention is related to the field of covers and shields to prevent leaves, other vegetation and non-liquid debris from entering rain gutter drains attached to houses and buildings. This invention describes gutter inserts that prevent, block or trap leaves and other vegetation and falling debris from entering and clogging gutter drains.

BACKGROUND

Leaves, twigs, other vegetation including natural plant parts and other non-liquid debris frequently falls or drifts into rain gutter drains, or rain gutters, or gutters, clogging them and hindering or preventing their intended function of draining water away from a house or building. Foam inserts are known to be used to fill a gutter with durable foam material and by filling the space of the gutter exclude leaves from filling the gutter. Most devices made to keep falling vegetative debris from rain gutters start on the roof shingles and extend over the gutter, they are not inserted into the gutter. Most consider it unwise to block the gutter, and in particular the base of the gutter. Even foam inserts are designed to avoid the base of the gutter. Installing covers over the gutter meanwhile can be difficult because the edge of the roof often dips low, sometimes very close to or into the trough of the gutter. Another problem with creating effective simple gutter covers is that gutters are interrupted at irregular intervals of about 18 to 30 inches by nails or support brackets that attach and hold the gutters to the building. The supports and other obstacles mean that foam inserts and other cover devices usually are inconvenient, difficult to install and look bad because they have to be either cut up leaving gaps in coverage or they sit on top of and or ride up out of the gutter. They are also relatively expensive. Some devices retain water which can promote the growth of bacteria, mold and other organisms. The way gutters are constructed and fastened to buildings have made it difficult to design a safe inexpensive solution to the problem of gutter being clogged by falling debris. Typically home owners just climb a ladder once or twice a year and manually unclog their gutters. Most gutter covers and screens available rest on top of the roof, or on top of the shingles on the roof, they extend over the full width of the gutter and run along its length in sections which are about 3 to 5 feet long. Often these devices require screws, bolts and or clips to fasten them onto the roof, gutter and or the building. Often the shingles and the roof itself are penetrated by nails or screws thus causing or inviting damage to the roof or shingles. Some gutter covers require lifting or prying up the shingles in order to install the covers which invites damage to the shingles, especially in cold weather. Many simple gutter covers are designed to snap or clip into place but in fact are difficult to install, and they don't always stay in their proper position. Better methods and devices needed to keep falling debris from entering rain gutters are described herein.

SUMMARY OF THE INVENTION

A gutter insert comprising at least one an upper blocking member, at least one vertical support member, wherein said upper blocking member and said vertical support member are engaged with each other over all or part of the distal edge of the upper blocking member and the proximal edge of the vertical support member, wherein said upper blocking members is flexibly engaged with said vertical support member. A gutter insert that is longer than it is wide. A gutter insert wherein said vertical support member has an edge or side away from said upper blocking member that is a bracing member, wherein said bracing member engages the inside walls, bottom or inside corner of a gutter. A gutter insert wherein said upper blocking member covers more than half of the open trough of a gutter when it is placed in a gutter. A gutter insert of wherein a) said upper blocking member is flexibly engaged with the proximal portion of said vertical support member, b) said bracing member is either part of or attached to the distal portion of said vertical support member, and said upper blocking member has a set back to allow overlap of multiple upper blocking members when more than one inserts are used in an adjacent manner in a gutter. The insert wherein said bracing member abuts the bottom inside back corner wall of the gutter when the insert is placed in a gutter. The insert wherein there is a gap between the distal edge of the upper blocking member and back wall of the gutter when the insert is placed in a gutter. The insert wherein the gap is greater than about ⅛ inch but less than 2 inches in width. A gutter insert for impeding the egress of non-liquid debris into a gutter, said gutter including a front wall terminating into a front lip, a back wall, and a bottom wall, said bottom wall extending between and connecting the front wall to the back wall, wherein said gutter insert comprises: a) an upper blocking member including means for engaging said gutter front lip, b) a generally vertical support member connected to said blocking member, said generally vertical support member including means for engaging the insert with the gutter at a location on or near the lower half of said bottom wall. A gutter insert where said generally vertical support member is flexible and engages the insert with said gutter near the corner of the bottom wall and the back wall of said gutter. A gutter insert wherein said upper blocking member is between about 3 to 7 inches wide and said vertical support member is between about 3 to 7 inches in height. A gutter insert wherein said insert comprises a detent. A gutter insert wherein said vertical support member has a distal edge that is a bracing member, wherein said upper blocking member and vertical support member are engaged at an angle such that the planes of the two members create an angle of any angle from about 50 to 120 degrees. A gutter insert wherein said detent is in a region of the insert between the upper and lower region of said vertical support member wherein said upper region of said vertical support member forms an angle with said upper blocking member of any angle, X angle between about 60 to 90 degrees and wherein said lower region of said vertical support member forms an angle with said upper region of said vertical support member, Y angle of any angle between about 100 and 140 degrees. Wherein said insert has a set back at the ends of the insert that allows inserts to overlap with one another, providing a continuous upper blocking member appearance, when placed adjacent to each other. Use of a gutter insert to keep rain gutters open and draining freely comprising an upper blocking member and at least one vertical support member, wherein said upper blocking member is comprised of a flat or rounded structure with its distal edge engaged with the vertical support member, wherein either or both the upper blocking member and the vertical support member may be divided into a multiplicity of pieces, wherein the distal portion of the upper blocking member and the proximal portion of the vertical support member are attached to each other, wherein said upper blocking member and vertical support member are attached such that they form an angle such that the plane of the upper blocking member is at an angle of less than 90 degrees and more than about 40 degrees when measured with the plane of the vertical support member, wherein the length of the insert is greater than 5 inches, wherein the width of said horizontal blocking member is between 2 and 7 inches, wherein the height of said vertical support member is from 2 to 6 inches, wherein said vertical support member is not engaged with said horizontal blocking member over its entire length, wherein the thickness of said article is between 0.001 and 0.5 inch, wherein said vertical support member(s) are flexible. Use of an insert wherein said horizontal blocking member has a surface that, when in position in a gutter, slopes either upward or downward with its proximal edge joined to the vertical support member and having its distal edge engaged with the lip of a gutter. Use of an insert wherein said upper blocking member is between about 3 to 6 inches in width, wherein said vertical support member is about 3 to 6 inches in height. Use of a multiplicity of said inserts to keep rain gutters open and draining freely wherein one or two inserts overlap with one or two adjoining inserts when placed in a gutter. Use of a gutter insert wherein said upper blocking member has a front edge that rests in or on the front lip of the gutter. Use of a gutter insert wherein said vertical support member has a bottom edge that rests in or near the inside bottom back corner of a gutter, where back is the side against the building.

A gutter insert comprising at least one upper blocking member, and at least one vertical support member, wherein the insert is placed into a rain gutter. The vertical support member may include at least one bracing member which rests against the inside of the gutter when in use. The insert wherein the upper blocking member(s) are flexibly engaged with the vertical support members. The insert wherein the upper blocking member is flexibly engaged with the proximal portion of the vertical support member and wherein the bracing member is either part of or attached to the distal portion of the vertical support member. The insert wherein the bracing member abuts the inside corner of the gutter when the insert is positioned in a gutter. In one embodiment the vertical support members do not extend to the edge of the insert, there is a space on either end of the insert, that is there is a "set back" or space that allows the upper blocking member to extend beyond the point where it joins with the vertical support member at the end of the insert and this "set back" allows for the overlap of upper blocking member from adjacently placed inserts. The "set back" can be of any length but in particular is described as being of about any of ¼, ½, 1, 2, 3, 4, 5, 6, 7, 8, 9, 10, 11, 12, or more inches in length. The set back means that in some embodiments the upper blocking member is not continuously joined to the vertical support member and as such the shape allows easy cutting, fitting and placement of the insert into the gutter. See FIG. 1, 2 and in particular FIG. 3 where the set back has reference number 212. The alternatives described with a "set back" where the vertical support members "set back" from the end of the insert is shown in several of the drawings.

The most popular style of gutter in the US and Canada is 5 inch "K" Style. The larger 6 inch "K" Style can handle more water flow, but is considered a commercial size, typically used on larger buildings. The inches are measured across the top of the gutter. Many of the drawings in this disclosure show the "K" style gutter. Where inches are provided in the specification and indicated as preferred, then they are in reference to a "K" style 5 inch gutter. Other styles and sizes may require routine adjustments and modifications from the sizes and dimensions provided herein. One such shape is the "U" or the "half pipe" shaped gutter. This style of gutter usually has no front lip; however the inserts described herein can be easily modified such that they fit over the front lip of the gutter rather an fitting into the inside of the front lip of the gutter, as is shown in FIGS. 14, 15, 16. This embodiment for the half pipe is described and claimed in greater detail herein.

Inserts are described wherein the width of the upper blocking members is greater than 2 and less than 10 inches, and wherein the length of the insert is greater than its width. The insert wherein the upper blocking members form an angle (See angle "x" in FIG. 4) of less than 10 but more than 20 degrees with the vertical support member. The insert wherein the vertical support members and the bracing members form an angle relative to each other (See angle "y" in FIG. 4) of more than 90 degrees but less than 180 degrees. A method of using or placing the insert in a gutter wherein at least one portion of the vertical support member contacts the inner walls or bottom of the gutter. The bottom of the gutter is also called the bottom wall. A method of using or placing the inserts described herein into a gutter wherein at least one edge of the vertical support member engages the bottom, or bottom wall of the gutter and at least one edge of the upper support member engages the internal front lip of the rain gutter. An alternative embodiment provides for the front edge of the insert to come over the top front edge of the gutter. This is shown in FIGS. 14, 15, 16. I describe a method of using or placing the insert in a gutter wherein at least one edge of the vertical support member engages either the inside back wall, the inside bottom wall, or both, especially within ½, 1, 1.5, or 2 inches of the lower back wall or the bottom back wall and especially within ½, 1.5, or 2 inches of the inside back corner 308 of the gutter. The inside back corner 308 of the gutter 300 is where the back wall meets the bottom wall of the gutter.

In many embodiments there is a gap of between 1/16 to 3, or 1/16 to 2 inches, or a gap of between ⅛ and 1½ inches, or a gap of between ¼ and 1 inches, or a gap of between ½ and ¾ inch, or a gap of between ¼ and ½ inch, between the back edge of the upper blocking member and the back wall of the gutter when the insert is in place. This gap is shown in side view in FIG. 4, and 12-16. In FIG. 4 the gap, or gutter gap is between the back of the upper blocking member 119 and the back wall 302. We describe a method of placing the insert into the gutter by pressing the insert into a gutter such that the bracing member is in the lower half of the gutter and the upper blocking member is either in or on the front lip of the gutter, or where the bracing member is in the lower half, lower one third or bottom wall of the gutter and one or more upper blocking members have their front edge close to or in the vicinity or in the front lip of the gutter, or where one or more bracing members is braced against the bottom wall and or corner of the bottom and back wall of the gutter and one or more of the upper blocking members has its proximal edge abutting the inside of the front lip of the gutter. The device and placement made in order to prevent vegetation from entering a rain gutter.

A gutter insert wherein the vertical support members do not extend the full length of the insert and are not engaged with the upper blocking member over its full length, wherein there is a space of from 2, 4, 6, 8, 9, 10, 12, 14, 16, 18 or 20 inches or more, off either end of the insert. Such a space, or as it is called here a "set back" allows the upper blocking member at the ends of the insert to overlap with the overhanging or "set back" portions of another insert. Thus when the entire length of the upper blocking member is not fully engaged with the vertical support members such that there is a "set back", cantilever or overhang which allows two inserts to slide over each other then a continuous upper blocking member can be presented in the gutter to keep leaves out of the gutter with no gaps or holes for the debris to gain entry. When fashioned properly the insert slide easily side to side in the gutter, allowing for proper placement and providing a continuous complete barrier to falling leaves, twigs and other debris. This placement and sliding of the insert pieces such that one can slide over the other provides for a continuous surface comprising the upper blocking member which can completely cover any length of gutter, as one piece is made to fit over the next piece and so on down the length of a gutter.

A gutter insert comprising at least one an upper blocking member, at least one vertical support member and at least one bracing member, wherein the upper blocking member has a width, measured from front edge to back edge, of at least one inch and no more than 10 inches, wherein the upper blocking member and vertical support member are attached to each other along the distal edge of the upper blocking member and the proximal edge of the vertical support member, wherein the vertical support member has a distal edge that is a bracing member, wherein the upper blocking member and vertical support member are engaged at an angle such that the planes of the two members create an angle of less than 100 degrees but more than 20 degrees, wherein the length of the insert is greater than its width. A gutter insert wherein the length of the insert is greater than 8 and less than 10 inches, wherein the upper blocking member and vertical support member are engaged at an angle such that the planes of the two members create an angle of 90 degrees or less and more than 30 degrees, wherein the width of the upper blocking member is between 2 and 7 inches, wherein the height of the vertical support member is from 2 to 10 inches, wherein the vertical support member is not engaged with the upper blocking member over its entire length, wherein the thickness of the article is between 0.001 and 0.5 inch, wherein the vertical support member is flexible. A gutter insert wherein the upper blocking member is not fully engaged with the vertical support member over its entire width and wherein a further embodiment wherein the upper blocking member is not attached to the vertical support member at its ends and where there is an overhang such that the upper blocking member extends up to 24 inches, or 23, 22, 21, 20, 19, 18, 17, 16, 15, 14, 13, 12, 11, 10, 9, 8, 7, 6, 5, 4, 3, 2, 1, ½, ¼, more or less inches beyond the vertical support member which holds the upper blocking member in place in position to prevent non-liquid debris from entering the gutter.

The gutter insert wherein the length of the insert is greater than 8 or 10 and less than 90 inches, wherein the upper blocking member and vertical support member are engaged at an angle such that the planes of the two members create an angle of 80 degrees or less and more than 40 degrees, wherein the width of the upper blocking member is between 2 and 5 inches, wherein the height of the vertical support member is from 2 to 6 inches, wherein the vertical support member is not engaged with the upper blocking member over its entire length, wherein the thickness of the materials used in the manufacture of the various members of the insert is between 0.001 and 0.50 inch, wherein the vertical support member is flexible. An insert wherein the thickness of the insert is between about 0.005 and 0.090 inch, between about 0.010 and 0.080 inch, between about 0.015 and 0.070 inch, between about 0.015 and 0.060 inch, between about 0.020 and 0.040 inch, about 0.060 inch, about 0.040 inch, about 0.020 inch, about 0.015 or about 0.010 inch thick, and where the flexible vertical support member may be straight or having a bend or with a detent.

Use of a gutter insert to keep rain gutters open and draining freely without clogging from falling leaves comprising an upper blocking member and at least one vertical support member, wherein the upper blocking member is comprised of a flat or rounded structure with its distal edge engaged with the vertical support member, wherein either or both the upper blocking member and the vertical support member may be divided into a multiplicity of pieces, wherein the distal portion of the upper blocking member and the proximal portion of the vertical support member are attached to each other, wherein the upper blocking member and vertical support member are attached such that they form an angle such that the plane of the upper blocking member is at an angle of less than 90 degrees and more than about 40 degrees when measured with the plane of the vertical support member, wherein the length of the insert is greater than 5 inches, wherein the width of the horizontal blocking member is between 2 and 7 inches, wherein the height of the vertical support member is from 2 to 6 inches, wherein the vertical support member is not engaged with the horizontal blocking member over its entire length, wherein the thickness of the article is between 0.001 and 0.5 inch, wherein the vertical support member(s) are flexible. The use of a device having a horizontal blocking member has a surface that, when in position in a gutters, slopes either upward, downward or is level and has its proximal edge engaged with the vertical support member down to its distal edge which engages the lip of a gutter. The use of an insert wherein the upper blocking member is between about 3 to 5½ inches in width, between about 3½ to 5 inches in width, between about 3¾ to 4¾ inches in width, between about 4-4½ inches in width, is about 4¼ inches in width. Use of an insert wherein the vertical support member is about 2 to 6 inches in height depending on the materials used, the exact shape of the insert and the size and shape of the gutter. The vertical support may be 2½ to 5¾ inches in height, about 2 to 4½ inches in height, between about 3 to 4 inches in height, between about 3¼ to about 3½ inches in height, is preferred, especially if the material used is aluminum of about 0.010 to 0.040 inches thick, and where it is often about 0.020 inch thick.

A rain gutter insert that is placed in a rain gutter, the insert having an upper blocking member which is engaged with at least one vertical support members, wherein the width of the upper blocking member is the same or less than the width of the gutter trough in which it is placed, wherein said insert has a length greater than its width, wherein said upper blocking member has a proximal edge that is parallel with its distal edge, wherein the upper blocking member is engaged at various intervals, at its distal edge with the proximal edge of said vertical support members, wherein the vertical support members have a proximal edge that engages with the distal edge of the upper blocking member, wherein the vertical support member has a distal edge that is parallel with both its proximal edge and with the distal and proximal edges of the upper blocking member, wherein the insert has a thickness that is less than 0.5 inch, wherein the distal edge of the vertical support member engages the back wall or bottom wall of a gutter. A gutter insert wherein the vertical support member extends to the bottom wall of the gutter. A gutter insert herein the vertical support member rests against the bottom corner of the gutter, or only against the bottom, bottom wall or only against the bottom corner of the gutter. A gutter insert wherein the vertical support member extends to the bottom wall of the gutter and rests against the back corner of the gutter or only to the bottom wall or only to the bottom back corner. A gutter insert wherein the upper blocking member is slanted from back to front, higher in the back and lower in the front. A gutter insert wherein the upper blocking member has a front edge that rests in or on the front lip of the gutter. A gutter insert wherein the upper blocking member has a width that covers less than 140% of the width of the gutter and in alternative embodiments only about 99% of the width of the gutter is covered, with the uncovered part of the gutter trough being closest to the house or building side of the gutter. In various embodiments, about 98%, or about 94%, 96%, 91%, 94%, 93%, 92%, 91%, 90%, 89%, 88%, 84%, 86%, 81%, 84%, 83%, 82%, 81%, 80%, 79%, 78%, 77, 76%, 75%, 74%, 73%, 72%, 71%, 70%, 69%, 68%, 67%, 66%, 65%, 64%, 63%, 62%, 61%, 60%, 59%, 58%, 57%, 56%, 55%, or about 50%, or any range of any of these percents of the gutter trough, as measured over the width of the gutter, front to back or back to front, is covered by the insert. A gutter insert wherein the uncovered part of the gutter trough is the side closest to the house or building. A gutter insert wherein the vertical support member is attached to the edge of the upper blocking member and the vertical support member extends from the upper blocking member down into the gutter and is supported by having the lower edge of the vertical support member rest against the wall or the bottom of the gutter. A gutter insert wherein the vertical support member has its lower edge resting against the bottom corner of the gutter. A gutter insert wherein the vertical support member consists of one or a multiplicity of attached or bent elements that extends from the upper blocking member to the inside of the gutter.

An article of manufacture comprising a metal or plastic insert used to keep rain gutters open and draining freely without clogging from falling leaves comprising: an upper blocking member and at least one vertical support member, wherein the upper blocking member is comprised of a flat or rounded structure with its distal edge engaged with the vertical support member, wherein either or both the upper blocking member and the vertical support member may be divided into a multiplicity of pieces, wherein the distal portion of the upper blocking member and the proximal portion of the vertical support member are attached to each other, wherein the upper blocking member and vertical support member are attached such that they form an angle such that the plane of the upper blocking member is at an angle of less than 90 degrees and more than about 40 degrees when measured with the plane of the vertical support member, wherein the length of the insert is greater than 5 inches, wherein the width of the horizontal blocking member is between 2 and 7 inches, wherein the height of the vertical support member is from 2 to 6 inches, wherein the vertical support member is not engaged with the horizontal blocking member over its entire length, wherein the thickness of the article is between 0.001 and 0.5 inch, wherein the vertical support member(s) are flexible. An article of manufacture where the thickness of the article is between 0.005 and 0.200 inch, is between 0.010 and 0.10 inch, is between 0.020 and 0.080 inch, and the article is made of plastic, is between 0.040 and 0.080 inch, is between 0.040 and 0.060 inch.

An article of manufacture comprising a gutter insert with a upper blocking member, and at least one vertical support member, wherein the upper blocking member has a width, measured from edge to edge, of at least one inch and no more than 10 inches, wherein the upper blocking member and vertical support member are attached to each other along the distal edge of the upper blocking member and the proximal edge of the vertical support member, wherein the upper blocking member and vertical support member are engaged at an angle such that the planes of the two members create an angle of 10 degrees or less and more than 20 degrees, wherein the length of the insert is greater than its width.

This application also includes descriptions of the following. Some of the gutter inserts may be called box or half box type that are longer than wide and supported by the inside bottom or walls of the gutter. The box or half box types may be made of hard, soft or flexible material. The inside or underside of the box or half box types are mostly open with a 50% or more hollow core.

Some of the gutter inserts described herein may be called table types, that are supported by vertical support units extending from the upper blocking member to the inside bottom or lower half, lower third or bottom of the gutter. The table type may have a spring hinge or simple be of flexible material which allows the upper blocking member to be folded flat for storage and then moved into place when in use.

A collapsible accordion type of gutter insert is described which covers more than half of the width of the top of a rain gutter and it supported by the inside bottom or bottom wall of the gutter. A collapsible insert when in expanded form is more than twice as long as in collapsed form. A collapsible insert that in expanded form is more than three, four, five, six, seven, eight, nine, ten, eleven or twelve times as long as in collapsed form. In alternative forms such a collapsible insert in its compressed form is one half, one third, one fourth, one fifth, one sixth, one seventh, one eighth, one ninth, one tenth, or less, than when in its expanded form.

Any of the inserts as described herein where the top of the insert is about 2% less than the width of the gutter or about 4, 6, 8, 10, 12, 14, 16, 18, 19, 20, 22, 24, 26, 28, 30, 32, 34, 36, 38, 40, 42, 44 or 46% less than the width of the gutter the insert is intended to be placed into.

An insert with fasteners and loops is described that covers more than half of the width of the top cross section of a rain gutter, and or is similar to any of the dimensions described for a collapsible insert, that is longer than it is wide and is supported by the inside bottom wall or front and back walls of the gutter. An insert made of fasteners and loops where the fasteners are hooks made of wire and the loops are made of wire and or metal wire.

An insert that is a table type of insert that is supported by one or more, preferably two vertical support members in opposition, spaced at regular intervals along the length of the insert wherein the vertical support members have a bracing member that is braced against or engages with either the front or back walls or bottom walls and preferably with the bottom wall corners and bottom of the front and back walls to support the top of insert which is either fixed or attached with a spring type hinge allowing the insert to be folded and then lowered and put into proper place in the gutter.

With any of the types of gutter inserts described herein the front edge of the insert can be positioned either inside the front lip of the gutter as is shown in most of the drawings, or over the top of the front lip 315 of the gutter, or on top of and over and down on the front lip 315 of the gutter as is shown in FIGS. 14, 15, 16.

The process of making and using the gutter inserts are described and claimed.

The use of any of the gutter inserts described in the specification or claims for the purpose of keeping rain gutters free of substantial amounts of falling vegetable matter and allowing the rain water to flow down the gutter.

DETAILED DESCRIPTION OF THE INVENTION AND ITS PREFERRED EMBODIMENTS

Figure 1:
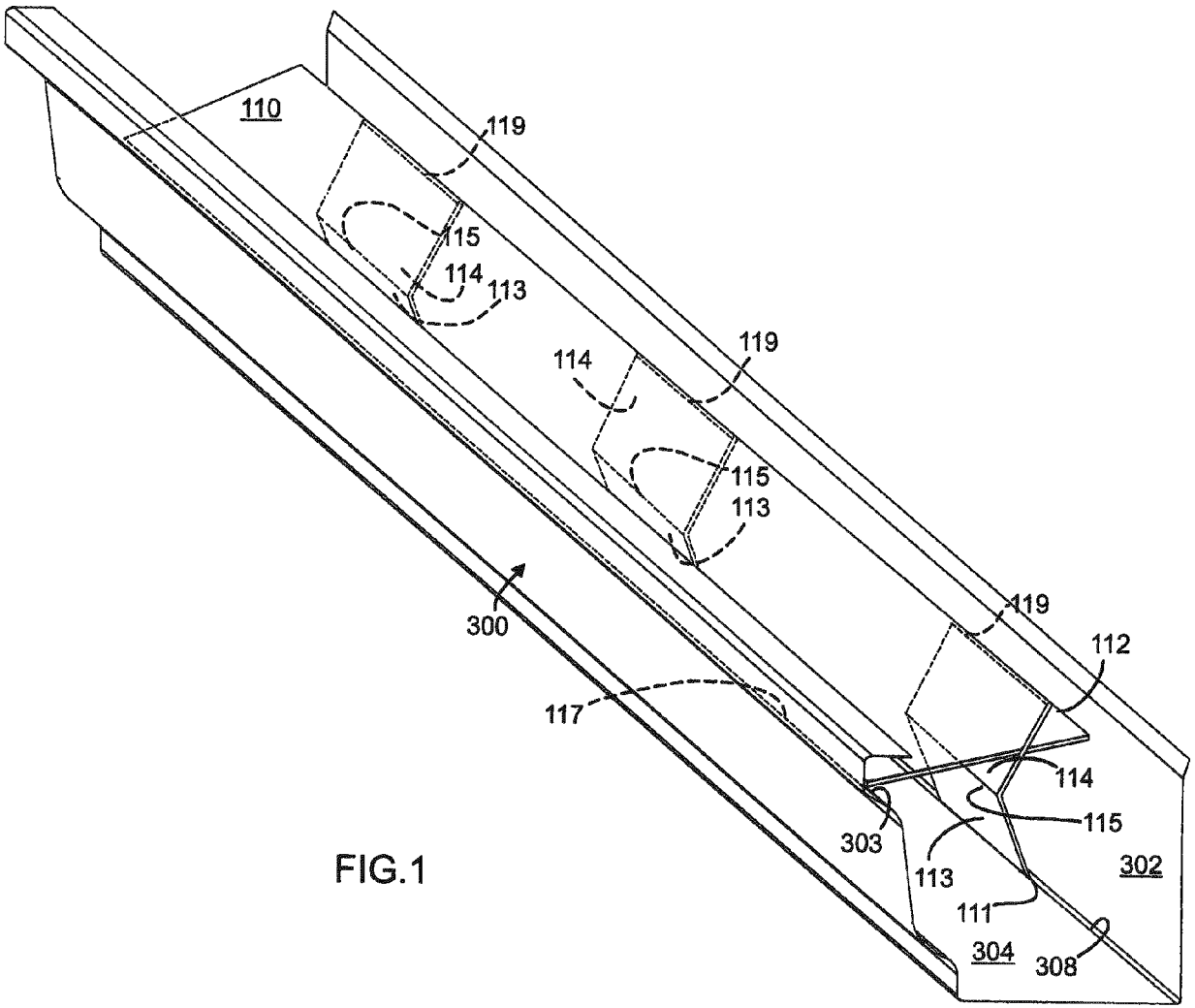
FIG. 1 is a perspective view of a gutter insert in a rain gutter. The gutter inset is a half box type, with three vertical support members joined with one upper blocking member. The lower edges of the vertical support members are bracing members engaged with the lower back wall of the gutter. The front edge of the upper blocking member is engaged with the front lip of the gutter.

Definitions.

"Deleted spring" refers to any material that has the classic shape of a coiled round or square spring only where a longitudinal section of the coils are missing. The term need not be a coil that seeks to return to its original shape after compression or stretching. Deleted spring simply refers to any shape that appears in any aspect to be a coiled wire or material that has parts of the coil missing. For example where the bottom is sliced out of a stretched spring leaving a spiral tunnel shape.

"Detent" means a bend that produces a change in the shape of the material. The bend can be sharply angled or a smooth shape like a half pipe.

"Dimensions" this document refers to the dimensions "length," "height" and the "width" of the gutters and gutter inserts. The "length" of the gutter and gutter insert is the measurement that runs the horizontal distance of the gutter and insert, when the gutter is attached to a building, in relation to the ground, from one point to another as one moves along the gutter with or against the direction of water flow. It is the longest dimension of the gutter 300. The "height" of the gutter 300 or "height" of the insert 10 is the vertical distance or measurement from the bottom, or bottom wall 304, or lowest part of the gutter to the top or highest part of the gutter 300. or height may by the height of the insert 10 which is from its lowest part to its highest part as it sits in proper position in the gutter as shown in the drawings. Top being that which is furthest from the bottom or bottom wall 302 when the gutter is attached to a building, furthest from the ground. The gutter 300 typically has a single height and it is the same whether measured at the front lip 315 or the back wall 302. The back wall 302 is the side against the house or building when the gutter is installed. The height of the gutter insert is typically measured from its lowest edge or the edge or point that rests in the bottom 302 of the gutter 300 straight up to the top edge or point of the insert that is furthest from the bottom. For many of the embodiments herein the insert 10 has an upper blocking member 110. The upper blocking member may be level or it can slope in one direction, either back to front or front to back. The embodiments shown in the Drawing slope from higher in back to lower in front, but this is not required. The width is measured from either the front edge to its back edge, of either the gutter or the gutter insert. The "width" of the gutter 300 and the "width", of the gutter insert 10, is the measurement from front to back or back to front, from the front lip 315 to the back wall 302 of the gutter 300, at a constant gutter height. Other widths can be specified. Unless specified otherwise, when the width dimension is in reference to the gutter 300, the measurement is taken at the top of the gutter and from the inside of the gutter, at the back wall 302 of the gutter 300, across the trough of the gutter 300, to the inside front of the front lip 315 of the gutter 300. The width of the bottom 304 of the gutter 300 could be specified and would be the width of the widest part of the lowest part, or bottom 304 of the gutter 300. Unless specified otherwise, when width is in reference to the gutter insert 10, the measurement of width is taken from the insert edge most towards the front 117, 217 straight across to the point or to the point in space vertical from any point or edge of the insert 10 most in back, frequently this point is about the same place as the back wall 302 of the gutter 300. Other dimensions are also specified, like the width of the upper blocking member 110, which would be the widest part of the upper blocking member 110 measured from front edge 117, 217 to edge 119, 219 closest to the back wall 302 of the gutter 300 in FIG. 4. The gutter gap is also shown in many of the drawings. The gutter gap is defined below.

"Gap" means gutter gap, defined below.

Figure 4:
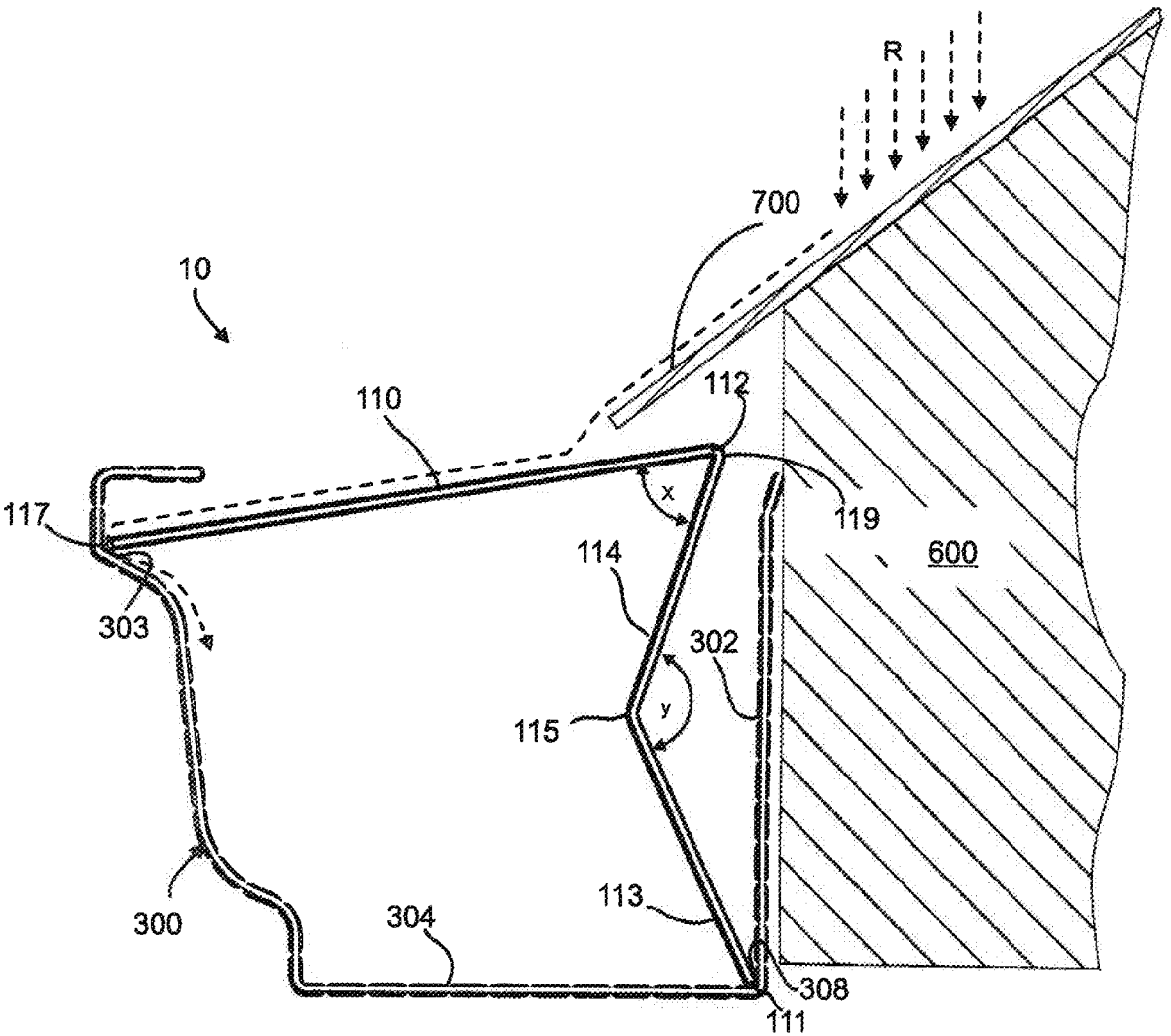
FIG. 4 is a side view of a half box type insert, in a gutter which is attached to a house or building. The roof with shingles is shown as it hangs over the gutter. The gutter is shown attached to side of the house. Rain and the path of water is shown with dotted lines and arrows
Figure 6:
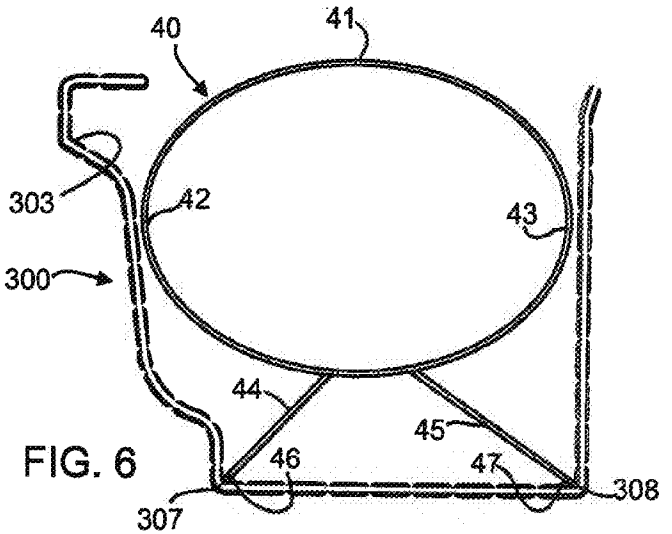
FIG. 6 is a side view of a gutter insert, half box, egg with legs style, in a K style rain gutter.
Figure 5:
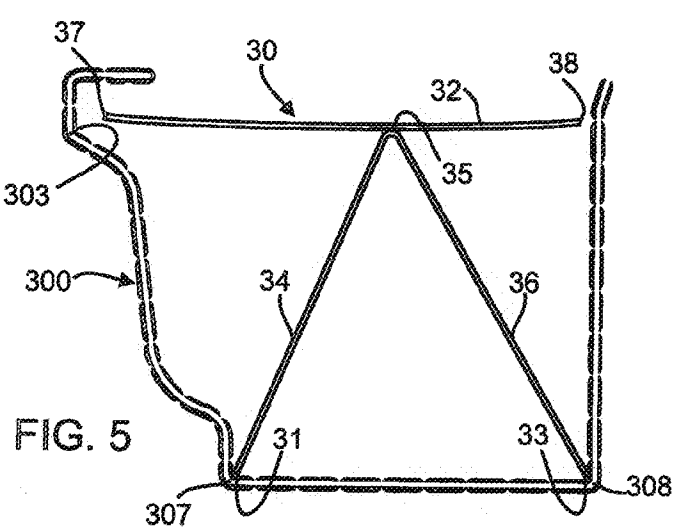
FIG. 5 is, a side view of a gutter insert, half box, table top style, in a K style rain gutter.
Figure 12:
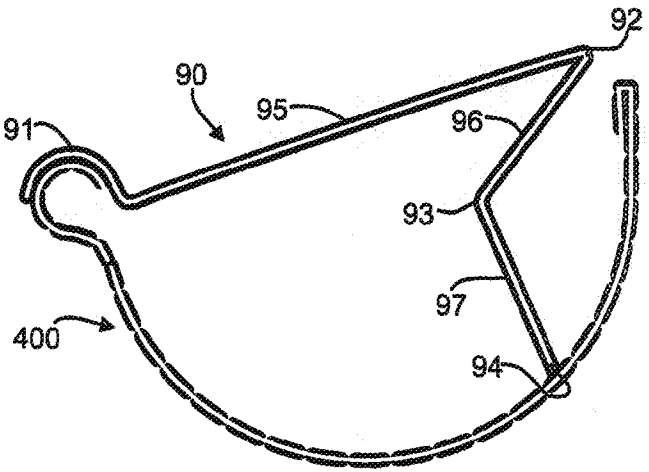
FIG. 12 is a side view of a gutter insert, with the insert having a front edge that wraps over the front lip of traditional half pipe style gutter.
Figure 9:
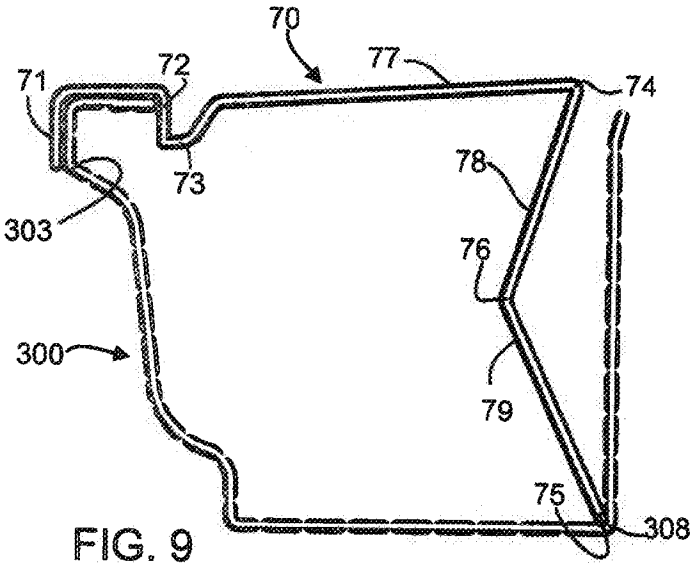
FIG. 9 is a side view of a gutter insert, half box, with the insert having a front edge that wraps over the front lip of the K style gutter.

"Gutter" means a drain or trap, typically a box or round tube shape that is open on one side and generally in the shape of the letter "U" where the bottom is flat or round. Gutters are installed just under the edge of the roof 700 in a position to collect rain water that falls off the roof. Often called a "rain gutter" 300 it catches and directs rain water into downspouts that then direct the water to designed places on or in the ground, usually away from the house or building. Gutters 300 typically have a front wall 310, a back wall 302, a bottom 304 and a top that is open as shown for example in FIG. 1. The back wall 302 of the gutter 300 is the side of the gutter that is closest to the house 600 or building 600 when the gutter is in place. FIG. 4. The front wall 310 of the gutter 300 is the side of the gutter away from the house 600, when the gutter is attached to the house 600 or the building 600. The front wall 310 of the gutter 300 sometimes has a front lip 315. The front lip 315 often has a slot, opening, groove or cleft framed by the front lip 315, which has a lip top 309, a lip front 306, and a lip bottom 303, and the grove runs lengthwise along the inside of the front lip 315 of the gutter 300. The front lip 315, grove is usually about ¼, ½, ¾ to 1 inch deep and across its opening. The opening is into the gutter. The front lip 315, and the slot, grove or opening in the front lip 315 is shown in FIG. 12.

"Gutter gap" refers to the space or distance between the back or distal edge 119, 219 of the gutter insert 10 and the back wall 302 of the gutter 300. The gutter gap is shown with particular clarity and in relation to the house in FIG. 4. It is the space between the back wall 302 of the gutter and the back or distal edge 119 of the upper blocking member 110. In several embodiments the gutter gap typically is from 1/16th, 1/8th, 1/4, 5/16, 3/8, 7/16, 1/2 9/16, 5/8, 11/16, 3/4, 13/16, 7/8, 15/16, 1, 1 1/8, 1 1/4, 1 3/8, 1 1/2, 1 5/8, 1 3/4, 1 7/8 to 2 inches wide, or any range thereof. Inserts with a gutter gap are especially useful as the gap allows for easier insertion of the gutter insert and it helps prevent any water that does drip into the gutter from backing up or overflowing and penetrating the flashing behind the back wall of the gutter and damaging the building.

"Gutter trough" means the open channel or interior space of the gutter. The trough is formed by the bottom 304 and two sides, which are the front or front wall 310, and the back or back wall 302 of the gutter. The top of the gutter and the gutter trough are open, to catch rain water dripping off the roof 700. In most of the drawings the gutter trough is shown with a gutter insert 10, and the trough is fully or partially covered by the upper blocking member 110 of the insert 10.

"Height" is a dimension, defined above.

"House", "Building" or "Structure" 700 are terms that are interchangeable and they refer to any building for personal or commercial use including personal dwellings, single or multi family houses, apartments, or commercial building of any type.

"Insert" means the same as "gutter insert" and is defined further in the summary and detailed description of the invention. In the drawings the insert is has the reference number 10, 70, 80, and 90.

"Length" is a dimension, defined above.

"Set back" 112 is used to describe the portions of the upper blocking members that are at the ends of the inserts and that are not in continuous engagement with the vertical support units. These set backs appear in the inserts shown in all the Figs. The set backs which may also be thought of as overhangs or cantilevers allow adjacent units to be positioned so they slide over one another thus allowing the upper blocking members to present a continuous barrier to any falling leaves and debris.

"Spring" or "flexion" refers to anything flexible that seeks to return to its original position when compressed or expanded and released. A spring can have but need not have the classic shape of a coiled spring. Spring can also just be a flexible material. Spring can be in an "L", "Z", "S", "W" or any other shape that can be compressed and when released will seek to return to the shape it had before compression. Spring refers to any object that can be squeezed or compressed and, once the compressive force is removed, it seeks to return to its original shape.

"Trough of the gutter" means the same as "trough" and "gutter trough" defined above.

"Width" is a dimension, defined above.

The Gutter Inserts are Described and Claimed with more Particularity.

This invention comprises gutter inserts that deflect falling vegetation such as leaves, seeds and twigs. The gutter inserts described herein do not require any screws, nails, clips or fasteners to install and they have a low visual profile. These gutter inserts do not rest on the roof or the roof shingles, many embodiments described herein do not even touch the roof or shingles. Many embodiments described herein do not cover the entire opening of the gutter. They are unlike anything ever seen or described before. They are easy to install and they impart only a slight, often imperceptible change in appearance to the gutter they are placed in. The gutter inserts described herein are supported and held in place by the inside walls and or bottom of the gutter, and yet they do not significantly slow or disrupt the flow of water down the gutter. In one embodiment, the inserts rest against the inside bottom corner or corners of the gutter. Selected designs are shown and other designs would be apparent to one after reading the description and viewing the figures disclosed herein. An important advantage of the gutter inserts described herein is the ability to lean a ladder against the gutter and place the insert in the same section of the gutter that the ladder is leaning against. Gutter covers that overhang the gutter are notorious for requiring some type of ladder adjustment, or the use of scaffolding. These devices can be deceptively dangerous because one is often tempted when trying to install them to leaning way off to the side of the ladder and this can result in instability and falls resulting in injury. The devices described herein eliminate these problems. Another important advantage of the gutter inserts described herein is that they can be quickly and easily removed. Traditional gutter covers that attach by way of clips, fasteners, screws or other mechanical means are notoriously difficult to remove and or replace. With many gutter covers installation and replacement is usually done only by a person with training, i.e. a person who derives an income from such work. The gutter inserts described herein can be easily installed and removed if needed, as well as replaced by the typical homeowner. The only tools needed to install most of the inserts described here is good pair of scissors, or a pair of light duty tin snips.

The inserts can easily be made of plastic materials. If made of clear plastic it allows one to easily see through them in order to inspect the inside bottom of the gutters. Alternatively, they can be made of inexpensive black plastic, or a dark coating on metal, which appears like the dark inside of a gutter and is thus nearly invisible and a dark color may provides for better snow melting properties. Because of their nearly "invisible" nature, some home owners will prefer a dark insert because of their properties and because colored plastic is usually cheaper than clear plastic. A colored insert can more easily be made of recycled materials. Metal inserts made of aluminum (Al), steel or Iron (Fe), galvanized steel, copper (Cu), nickel (NI), titanium, pot metal and alloys of these or other metals. Any alloy that is durable. Thin metal, less than 1.0 inch, preferably less than 0.5 inch is preferred, so that even using metal inserts the only tools needed to install most of the inserts described here is good pair of scissors and often nothing at all.

The most common gutters in use are often described as "K type" gutters and are shown in the figures. Gutters come in different widths and the inserts should be made of a size that best fits the individual gutter. Specific sizes and dimensions are described below. A properly sized gutter insert will easily fit into the gutter and slide side to side in the gutter. Slide to side sliding allows the ends of the inserts to overlap one another leaving no gaps or spaces between inserts where leaves can enter the gutter openings. The ability to overlap inserts with a minimum of cutting and shaping means an installer can make fewer trips up and down the ladder, which means more efficient use of time and a reduced risk of falling.

The rain gutter inserts described here, herein "inserts," can be one of, or a combination of several basic types. For convenience this document groups the various types of inserts described. The basic style types are: a) "accordion;" b) "box," including "half box;" these insert when viewed from the side, may appear to have one or more full or partial triangle shapes and often are made to lean into the front lip 315 of the gutter 300; c) "spring and hook" types, and the d) "table" type of insert.

The accordion insert is placed into the gutter 300 in a form that is collapsed in length. Once in the trough of the gutter 300 it is positioned properly and then expanded, or pulled open, to its final form in the gutter 300. Box inserts are placed into the gutter 300, sometimes after a bit of compression. One version of the box insert is called a half box insert and is shown in FIGS. 3-9. The box insert fits into the gutter with the front edge of the insert either in, close to, or slightly above the front lip 315 of the gutter 300. The box insert has one or more or a multiplicity of upper blocking members 110 supported by one or more or a multiplicity of vertical support members 120, 130 The vertical support members 120, 130 may have a detent adding to their flexibility. The vertical support members 120, 130 may also use spring devices to better collapse and then expand into the proper position. In some embodiments there are bracing members 113, 118, that may be identified as the part of the insert that typically rests in the back 302 or bottom 304 of the gutter 300. Bracing members are either part of, or are attached to, the vertical support members 120, 130. Bracing members help keep the front edge 117, 217 of the upper blocking member 110 in its proper position close to or in the front lip 315 of the gutter 300. In one embodiment, shown in FIGS. 4, 7, and 8, the rear top of the gutter insert 119, 219 sits above the top level of the gutter 310, and the upper blocking member 110 slopes down towards the front lip 315 of the gutter as shown. In one embodiment, shown in FIG. 3 the upper blocking member 110 has a hole added to the front edge that rests in or near the front lip 315 of the gutter, to facilitate the flow of water into the gutter. Also disclosed are versions of the insert 10, 20 where instead of a hole the insert edge 117 has a dimple either pressed into the insert or attached to the top of the insert such that it forces a space between the front edge of the insert 117 and the inside top of the front lip of the gutter 309, thus facilitating the flow of water into the gutter. The vertical support member may be flat or sloped, the sloped embodiments are shown in the drawings but sloping is not required for all the disclosed embodiments. FIG. 4 has a detent midway between the upper and lower part of the vertical support member 120, 130. This detent could be placed at any position along the vertical support member 120, 130. The spring and shield type of insert involves placing a large spring like structure into the gutter and then attaching a upper blocking member to the spring. The inserts can be placed in the gutters either before or after the gutters are installed on a house or building.

The Collapsible Type Insert.

In one aspect of the invention the collapsible insert is put in place in the gutter in the following manner: Beginning with the insert in its collapsed form, it is placed into the gutter and under the edge of the roof, and then it is expanded to fill the gutter. The insert is shaped to fill the top of the gutter. The shape can vary from a dome to a more preferred shape that fills the top of the gutter. The very top of the insert can be flat, sloping or domed. It may slightly sloped forward, away from the house, with a high side against the house and a slightly lower side away from the house. The side of the insert should fit close to the side of the gutter to keep leaves and other debris out of the gutter. The bottom of the insert is open to allow water to flow in the gutter. The bottom of the insert optionally may have wire or other supports across the bottom of the insert as long as the flow of the water is not significantly blocked. The lower sides of the insert can fit snugly against the walls of the gutter thus adding to the insert being secured into the gutter. This snug fitting is not required. The insert can simply rest loosely in the gutter. A snug fit is optional and not required, but, if desired, can be accomplished by springs or shaping the insert, clips, Velcro, magnets or other means. Adhesives could even be used. Optionally, there are tabs, hooks, or wires at each end of the insert to allow it to be secured to nails or supports that hold up the gutter and fix the gutter to the house or building. The typical length of the insert in this configuration is about 2-3 feet expanded, that being the approximate distance commonly used between the gutter support nails or brackets. This same insert of 2-3 feet expanded, when collapsed, can be a relatively thin 1-3 inches depending on the material used, and in that configuration it is easily slid sideways into the gutter, turned and expanded and placed into final position. The collapsible insert is first placed into position, expanded and finally secured to the gutter supports.

The Box Insert.

The box insert can be solid or compressible, if compressible a flexible material would be used. A solid insert can be made of nearly any material. A compressible insert would need to be made of a flexible material. Adhesives can also be used in combination with these materials either in their manufacture or installation.

The "Half Box" Version of the Box Insert.

Figure 10:
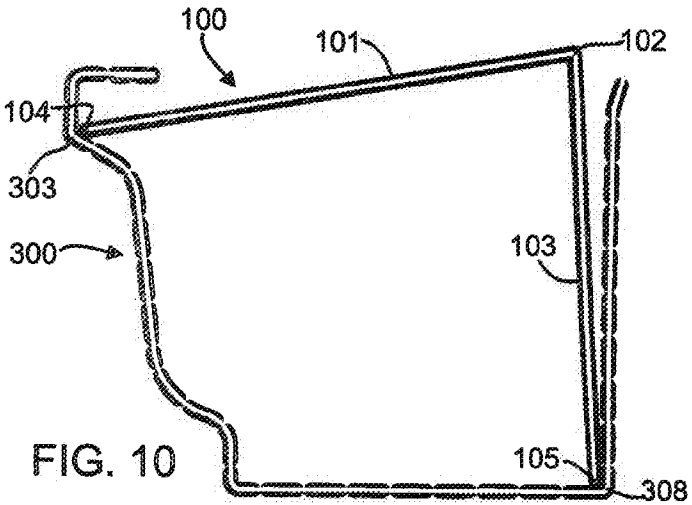
FIG. 10 is a side view of a gutter insert, half box, straight leg, with the insert having a front edge that rests inside the front lip of the K style gutter.
Figure 13:
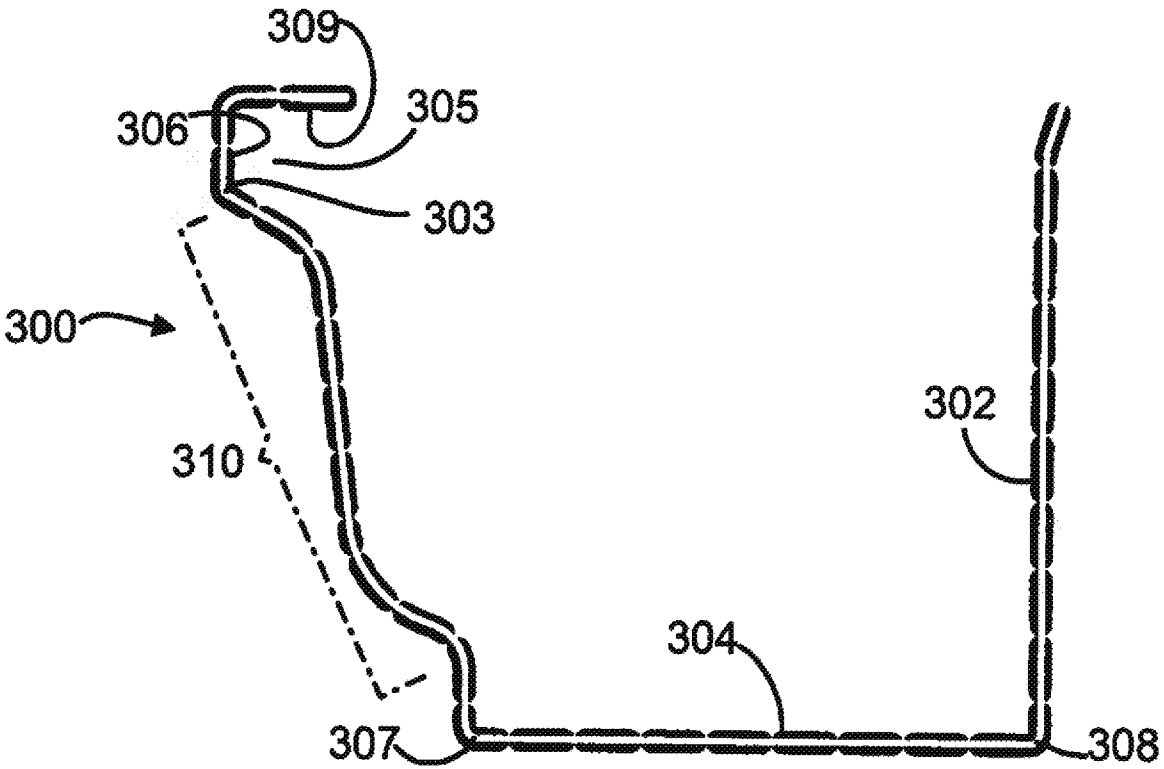
FIG. 13 is a side view of a "K" style gutter with details of the front lip.

The "half box" insert is specially shaped and shown in FIGS. 3-10. In one embodiment the half box insert, when in place in the gutter 300, rests with one edge 117, 217 of one or more upper blocking member(s) 110 which rest on or inside the front edge 303 of the gutter 300 and one or more vertical supporting members 120, 130 extends down into the gutter 300. The vertical supporting members 120, 130 are comprised of an upper part 114, 116 and a lower part 113, 118 and frequently but not always an area of detent 115. In one embodiment the half box insert rests with the lower part of its vertical supporting member 120, 130 against the bottom 304 of the gutter, and in one embodiment the vertical support member 120, 130 has a bend or detent and the bracing member 111 fits into the lower bottom corner 308 of the gutter 300. The lower part 111, 113, 118 of the vertical support member 120, 130 is called the bracing member 111, 113, 118. The bracing member 111, 113, 118 is usually continuous with and made of the same material as the vertical support member 120, 130, but it serves a different purpose. The bracing member 111, 113, 118 serves to anchor and brace the insert in place in the gutter. The bracing member 111, 113, 118 will typically be formed by making part of the vertical support member 120, 130 bend toward the back wall 302 of the gutter 300, thus forming the bracing member 111, 113, 118. The bracing member 111, 113, 118 can be created by either bending the vertical support member 120, 130, or it can be made by attaching a bracing member 111, 113, 118 to the vertical support member 120, 130. In FIG. 1 the bracing member is either attached or the part of the vertical support member 114, 116. The bracing member 111, 113, 118 terminates at the bottom 111, of the vertical support member 113, 118. The terminal part 111 of the bracing member 113, 118, can be placed at any position in the gutter but is usually placed in the bottom corner 308 of the gutter. The bracing member is usually continuous with the vertical support member, made of the same piece and with the same material as the vertical support member. It is either near its top, in the middle, or as is shown in in the drawings near the bottom of the vertical support member 120, 130. It is also possible to create a bracing member 113, 118 by bending the vertical support member 120, 130 into the proper position. Thus the bracing member 113, 118 can be created by either bending the vertical support member 120, 130 or by separate creation and attachment of a separate and distinct bracing member 113, 118 to the vertical support member 120, 130. One of ordinary skill in the art will be able to make a wide variety of bracing members. The back wall 302 of the gutter 300 is defined as the wall of the gutter that is closest to the house or building structure 600 when the gutter is fitted to same. The detent 57, 64, 76, 83, 93, 115 is such that the vertical support member 120, 130 appears as two planes joined but may also be simply a straight vertical support member 120, 130, such as is shown in FIG. 10, at 102. Detents provide a little more "spring" to the vertical support member, and ensuring that the lower portion of the vertical support member.

FIGS. 15, 16 and 17 show the angle X, in FIG. 4, between the upper blocking member 110, 210 and the vertical support member 120, 130. This angle X between the upper blocking member 110, 210 and the vertical support member 120, 130 should generally be less than 110 and greater than 20 degrees. Specifically the range of the angles formed by the angle X has any of the following ranges or numbers exactly or approximately, 20-100, 30-90, 40-80, 50-60, 30-50, 40-40, 40-80, 50-80, 40-60, 60-80, 70-90, 70-80, 80-90, degrees of angle. Specifically 45, 50, 55, 60, 65, 70, 75, 80, 85, More precisely 75, 76, 77, 78, 79, 80, 81, 82, 83, 84, or 85 degrees or degrees of angle. See FIG. 4. Note the vertical support member is often itself comprised of two or more sections that form an angle at their attached top or distal edges 112, 52, 62, 74, 82, 92, 102. The angle Y in FIG. 4, between the upper blocking member 110 and the vertical support member 120 or the upper part of the vertical support member 114, 85, 78 can be 0, zero degrees (or 180 degrees depending on the perspective), that is, no appreciable angle or detent in any part of the vertical support member 120, including the bracing members 113, 118 or it can be anywhere between 180 (no angle) and 20 degrees. The angle Y is most often about 180, 170, 160, 150, or more degrees, with the optimal angle being about 180, 170 or 160 degrees as shown in FIG. 4. Specifically this angle Y is most often between 160 and 180, between 150 and 170, between 140 and 160, between 50 and 150, between 60 and 180, between 180 and 170, between 180 and 150, or on or about 120, 125, 130, 135, 140, 145, 150, 160, 165, 170, 175 or 180 degrees of an angle, or any range between any two of these numbers.

The upper blocking member 110 can also be made from 1, 2, 3,4, 5, 6, 7, 8, 9, 10 or a multiplicity of members.

In various embodiments the following are described: Gutter inserts having an upper blocking member with a width that covers from 40 to 99% of the top opening of the gutter, with the open part of the gutter insert called the gap, or gutter gap running the length of the gutter closest to the house or building and typically resting under the overhanging shingles when the insert is in place in a gutter on a house, with the insert having a length greater than its width, with the upper blocking member attached to a vertical support member that extends into the trough of the gutter and terminates in a bracing member 113, 118. The bracing member 113, 118 may extend to the bottom of the gutter and rest against the inside wall or bottom 304 of the gutter and it may rest against either or both inside corners of the gutter. In one embodiment the bracing member 113, 118 rests against the inside corner of the gutter closest to the house 308. The upper blocking member 110 may be slanted from back to front, higher in the back and lower in the front. The upper blocking member 110 may have a front or proximal edge that rests in or on the front lip 315 of the gutter. The upper blocking member 110 may have a width that covers less than 10% of open trough of the gutter when viewed from above looking down into the gutter, and in alternative embodiments only about 99% to 50% of the width of the open gutter trough is covered, with the uncovered part of the gutter trough being closest to the house or building side of the gutter.

Figure 7:
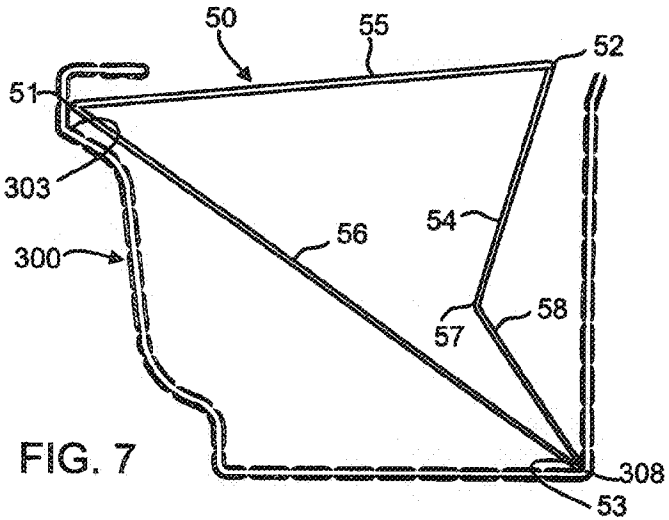
FIG. 7 is a side view of a gutter insert, half box, triangle style, in a K style rain gutter.
Figure 11:
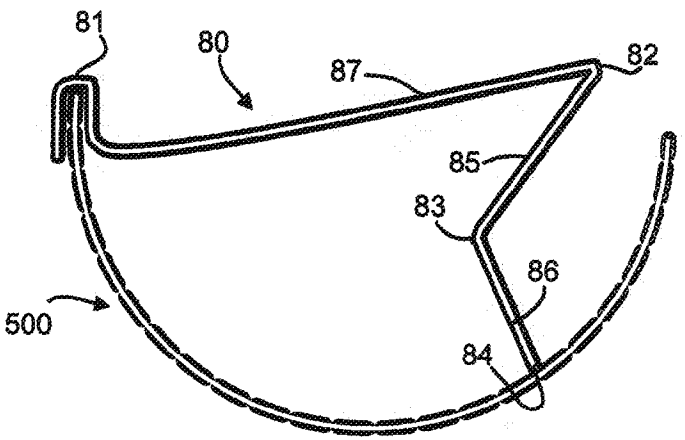
FIG. 11 is a side view of a gutter insert, with the insert having a front edge that wraps over the front lip of half pipe style gutter.

In the embodiment shown in FIG. 7, the upper blocking member 110 rests with its front or proximal edge either in or close to the front lip 315 of the gutter 300 and the proximal edge of the vertical support member 120, 130 is attached to the rear or distal edge 119, 219 of the upper blocking member 110. The lower edge 70 of the vertical support member 120, 130, called the bracing member 113, 118 abuts against the bottom 304 of the gutter 300, and more preferably against the bottom 304, and or, inside back corner 308, of the inside of the back wall 302 of the gutter 300. The inside of the back wall 303 corner 308 is where the back edge 70 of the vertical support member 120, 130, or the bracing member 113, 118, of the insert 10 rests in the gutter 300 in one embodiment. One alternative embodiment has the bracing member 113, 118 of the vertical support member 120, 130 resting with the lower edge 70 of the bracing member 113, 118 against the bottom front corner 6 of the gutter 300. The inside or back gutter wall 302 is the side of the gutter that is nearest or closest to the house 600 or building 600 when the gutter is installed, see FIG. 4. In FIG. 4, the back wall 302 of the gutter may rest against the building 600 and sometimes flashing (not shown) will extend from under the roof and extend either behind or over the back wall 302 of the gutter 300. The outside or front gutter wall 310 is the side of the gutter that is away from the house 600 or building 600. The gutter insert 10 is designed to fit in the gutter 300 such that a portion of the vertical support member 120, 130, and the bracing member 113, 118, rests against the inside of the gutter 300. The gutter gap when present is shown as the space between the back wall 302 of the gutter 300 and the back edge 119, 219 of the insert 10. The gutter gap acts to both ensure water does not flow or back up into the walls of the building 600 and it helps to allow easy insertion and removal of the insert 10, into the gutter 300, see FIG. 4. The front lip 315 of the gutter 300, is sometimes called the lip, gutter lip, or front gutter lip 315, and it is on the outside wall 310 of the gutter 300. The outside wall is the side of the gutter that is away from the house or building. The front lip 315 appears to form what looks like an overhang of the gutter, when viewed from below or in profile. This overhang or front lip 315, as it appears on some gutters, often has a grove or space 308 of about ¼ to ½ to ¾ to 1 inch wide and deep, running the length of the gutter. The front wall of the gutter 300 often drops down in a curving shape, to connect to the bottom 304 of the gutter 300. The front wall 310 of the gutter 300 is the wall or side of the gutter furthest from the house, when the gutter is attached to the building. The front lip 315 is located at the top of the front wall of the gutter 300. In one alternative described here and shown in the drawings, the upper blocking member 110 of the half box style of gutter insert 10 rests either in, close to, or against the front lip 315 of the gutter, at or near position 117. In one alternative the upper blocking member 110 is supported by the inside of the gutter by the front wall of the gutter either in or near the front lip 315 of the gutter 300. In one alternative the upper blocking member 110 is supported from the inside of the gutter 300 by the front wall of the gutter 310 either in or near the front lip 315 of the gutter 300. The insert remains fixed in this approximate position because of the bracing member(s) 113, 118 which are supported from the inside bottom 304, and or inside back corner 308, of the back wall 302 of the gutter 300.

Figures 2, 3:
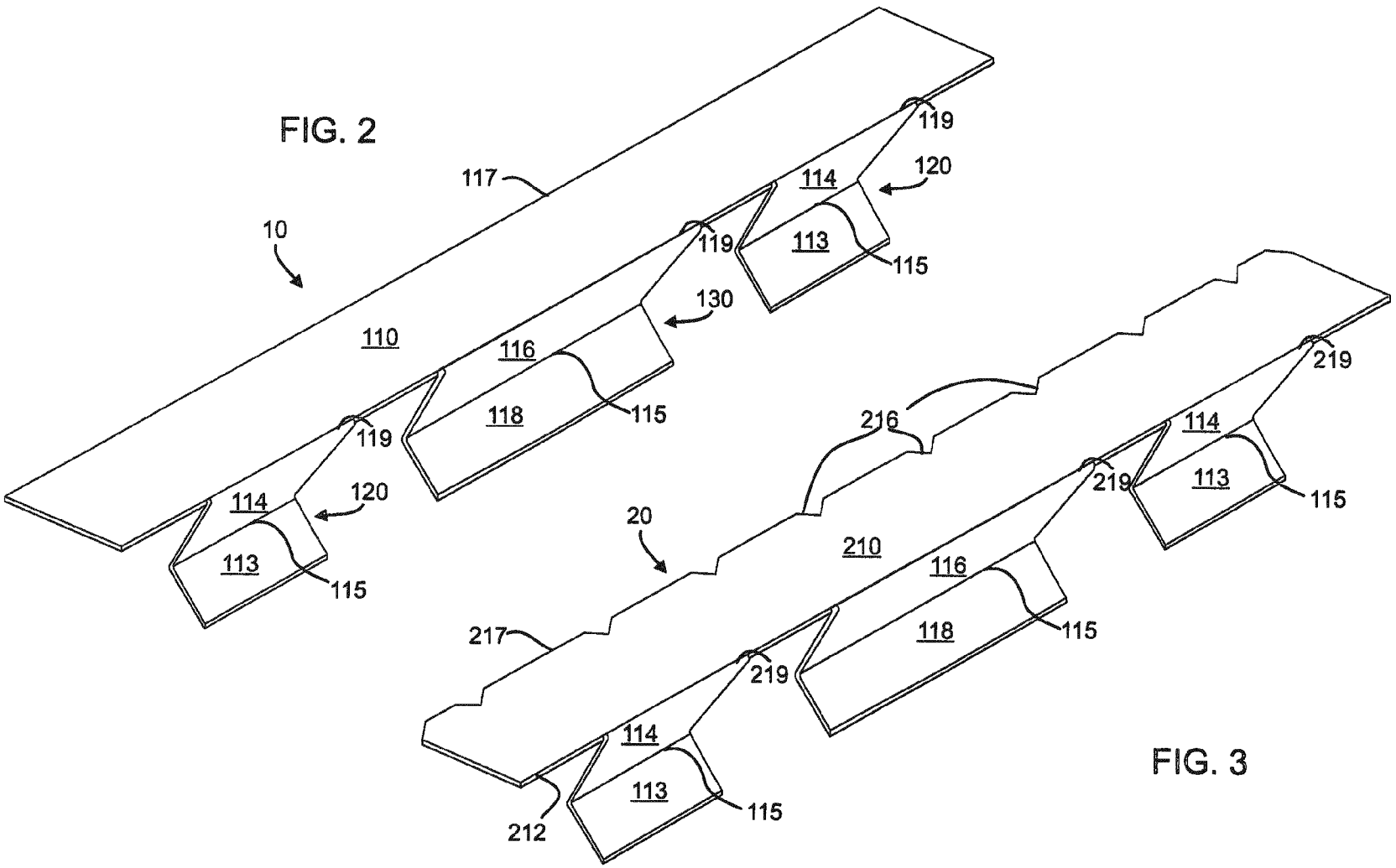
FIG. 2 is a perspective view of a gutter insert with three vertical support members joined with one upper blocking member.
FIG. 3 is a perspective view of a gutter insert with three vertical support members joined to one upper blocking member where the upper blocking member as "v" shaped notches cut into its front edge.

Optional drainage channels such as cuts, holes, vents, screen or mesh openings in the upper blocking member 101 may be made or included in the devices. Drainage channels or holes should be made in the inserts that have a front edge that goes over the top of the front lip 315 of the gutter 300 as shown in FIGS. 14, 15, 16. These drainage channels can be made into the upper blocking member 110 of the insert 10 at the lowest point of the channel in the front of the insert in order to facilitate the drainage of water into the gutter 300. Such drainage channels are typically made on the edge of the insert closest to the front lip 315 on the inside of the gutter, i.e. near the front edge 117, 217 of the insert 10. FIG. 3 shows triangle shaped holes 216 in the front edge 217 of the upper blocking member 110. FIG. 3 shows these holes, which are an area of perforation 217 made in or near the edge of the insert 117, 217 that rests against the inside front lip 315 of the gutter 300. Holes, cuts, screens or mesh or other porous materials can be used to facilitate drainage of water from on top of the upper blocking member into the gutter and the holes may be of various sizes, types shapes and locations. Care should be taken however to make the holes small enough such that most leaves and debris are prevented from entering the gutter trough. It is recommended such drainage channels be less than 3 inches in diameter, less than about 2 inches, or less than about 1 inch. The upper blocking member 110 may simply be a screen designed to facilitate the passage of water but block most leaves or debris from entering the gutter, usually less than about 3 inches in diameter.

An alternative method of making a drainage channel without cutting or drilling holes into the upper blocking member 110 of the insert 10, in order to facilitate the drainage of water into the trough of the gutter 300, is to make the upper blocking member 110 with bumps or dents such that the upper blocking member 110 such that it cannot be rest pressing smoothly against the inner upper part of the front lip 315 of the gutter, i.e. the front edge 303 of the insert 10, rather such bumps or detents force the upper blocking member 110 down a little short distance which allows water to flow into the gutter 300 but keeps leaves and other vegetation out of the gutter 300. Such drainage channels are typically made on the edge of the insert closest to the front lip of the gutter, i.e. in the front edge 303 of the upper blocking member 110.

Many materials can be used to make the gutter insert thin enough, or porous enough such that no cuts are needed and the water simply flows inside the front lip 315 of the gutter and down into the gutter trough. Many styles and places of cuts or drains can be used, if desired. Once inserted, any leaves dropping, falling, or flowing into the gutter from the roof or sky, are deflected away from the trough of the gutter and will fall harmlessly to the ground. By keeping leaves, twigs, needles and other debris out of the gutter trough, the gutter inserts keep the gutters flowing freely without clogging and overflowing.

The vertical support member(s) 120, 130 of the gutter insert 10 can be 1, 2, 3, 4, 5, 6, 7, 8, 9, 10 or a multiplicity of distinct supports, and it can terminate in at least the same number of bracing members 113, 118. The vertical support member(s) 120, 130 and the bracing members 113, 118 can be curved, straight, or of various shapes. FIGS. 1-9 are provided to show both curved and straight vertical support members. Three examples of various inserts are shown in FIGS. 1-9. FIG. 3 shows a half box where two supports 120, 130 make a triangle shape. FIG. 4 shows a half box with a curved vertical support member 120, 130. The vertical support member 120, 130 is shown with a bracing member 113, 118 fitting into the rear bottom corner 308 of the gutter 300, but bracing member 113, 118 could be made and positioned such that it fits into the top or middle of the back wall 302, or the bottom 3, even the front wall, or as preferred in the back corner 308 of the gutter 300. It could be fashioned such that both front 6 and rear 308 corners of the gutter hold the vertical support members 120, 130 in place. Alternatively the bracing members 113, 118 can rest against the back wall 302 of the gutter at a position in the upper ¼, ⅓, ½, ¾ or other such that bracing members 113, 118 does not need to touch the bottom 304 of the gutter 300. The vertical support member(s) 120, 130 and the bracing members 113, 118 do not need to run the entire length of the gutter insert 10. It is preferred to cut the vertical support members at or near the point of attachment to the upper blocking member 110 as shown in FIGS. 2 and 3 at 112, thus both allowing for easier installation (allowing placement over the gutter supports or brackets) and reducing the amount of material needed to make the insert. A multiplicity of two, three or more vertical support member(s) 120, 130 and the bracing members 113, 118 attached to one or two, preferably a single upper blocking member 110 makes an insert that is easier to install because it can be more simply fitted over the brackets or nails that are used to attach the gutter to the house or building and these troublesome brackets then are used to advantage, helping to support and keep the inserts in the proper position. The insert 10 shown in FIGS. 1-10, is easy to make and install. FIG. 1 shows an insert with one upper blocking member 110 attached to three vertical support member(s) 120, 130 and bracing members 113, 118. The insert is designed to be compressed and inserted into a gutter 300, such that when in place the insert sits in the proper position with its front edge 303 of the gutter insert 10 resting close to the front lip 315 of the gutter 300. The insert 10 can be fashioned in various designs and made of various materials. FIG. 1 shows the gutter insert 10 of a shape that allows easy trimming for installation, as mentioned above in reference to its having several separated vertical support member(s) 120, 130 and the bracing members 113, 118 attached to the upper blocking member 110. It is easy to cut the inserts of any shape needed for installation as only the upper blocking member need be cut rather than having to cut both the upper blocking member and the vertical support member. The insert 10 can be made and sold in one convenient piece and then cut to a multitude of shapes as may be needed by the person installing the insert 10. The unique shapes shown in the drawings allow for easy installation by professionals and amateurs alike. The gutter insert 10 can be cut and trimmed to allow various segments of the insert to be easily formed and then placed into the gutter 300. Nearly any gutter 300 can be accommodated with either the inserts shown in the drawings or variants thereof. Once in place in the gutter 300, the inserts 10 can be left in the gutter indefinitely, or as long as desired. If the inserts 10 are made of transparent materials then visual inspection of the inside and bottom of the gutter is made easy.

The vertical support member 120, 130 may be made of one, two or a multiplicity of supports having various shapes. FIGS. 3-8 show an insert with a vertical support member 120, 130 being bent such that it appears to have two parts (a) and (b), that compose the vertical support member. The vertical support member may have a detent as shown in FIGS. 2, 3, 4, 7, 8 to increase its spring like ability. FIG. 4 shows a vertical support member where the bending is such that the vertical support member appears to be a single curved support.

In one embodiment, the insert has a lower edge of the vertical support member that rests against one or two of the bottom corners of the gutter. The inside (i.e. side closest to the house) bottom corner of the gutter is the corner of the gutter where the bottom of the gutter meets the back wall of the gutter, the back wall being the wall of the gutter closest to the house when the gutter is installed. In one embodiment, the insert has an edge 117, 217 of the upper blocking member 110 that rests against, in or close to the inside of the front lip 315 of the gutter 300. The front of the gutter is the side of the gutter 300 that is away from the house, when the gutter is attached to the building. In a preferred embodiment the insert 10 has an edge 117 of the vertical support member that rests against the inside bottom corner of the gutter 308, the vertical support member is attached to the upper blocking member 110 of the insert 10 which has an edge (117, 217) that rests against, in or close to the inside 8 of the front lip 315 of the gutter 300.

The gutter inserts may be rigid but they seem to work best when they are flexible. The flexible versions can be compressed for easy placement into the proper position in the gutter. The flexible inserts can be compressed, and when the compressive force is released they will try to assume their original shape which puts them in the proper position in the gutter. Flexible inserts are preferred. Flexible inserts can be compressed, placed into the gutter, and then, when the compression is released, they will assume a shape that allows one end or edge 117, 217 to fit neatly in or near the inside of the gutter lip 7 which is at the top of the gutter and the other end or edge of the insert 70 fits neatly into the bottom corner 308 of the gutter 300. The inserts may be shaped so that either bottom corner is utilized.

The vertical support member 120, 130 is attached to the upper blocking member 110 of the insert 10 and the vertical support member 120, 130 extends from the upper blocking member 110 down into the gutter 300 where it rests with its lower edge 70, which is part of the bracing member 113, 118, abutting the walls 302 and or the bottom 3 of the gutter 300. The vertical support member(s) 120, 130 consists of one or a multiplicity of attached or bent elements that extends from the upper blocking member 110 to the inside of the gutter 300.

The upper blocking member 110 can also be made from 1, 2, 3,4, 5, 6, 7, 8, 9, 10 or a multiplicity of members.

Specific Examples of Dimensions of the Half Box Insert

Length. Herein is described a gutter insert 300 of a half box style that has a length between 11 and 110 inches and where the length of the upper blocking member 110 can be any length, but the following lengths are specifically described. Details are provided where the gutter inserts of a box or half box style are particularly described that are between 10 and 110, 20 to 110, 30 to 110, 40 to 110, 50 to 110, 60 to 110, 11 to 80, 11 to 70, 11 to 60, 11 to 50, 11 to 40, 11 to 30, 15 to 70, 15 to 60, 15 to 50, 15 to 40, 20 to 30, 20 to 40, 20 to 50, 20 to 60, 20 to 70, 20 to 80, 25 to 50, 30 to 40, 30 to 45, 30 to 50, 30 to 60, 30 to 70, 40 to 50, 40 to 60, 40 to 70, 30, 31, 32, 33, 34, 35, 36, 37, 38, 39, 40, 45, 50, 55, 60 inches in length. Or any with approximately the same or falling on or between any of these specific lengths Width. The upper blocking member 110 is anywhere from about 2 to 7 inches in width, (width is measured front to back across the top of the gutter) and specifically it may be about 2, 2¼, 2½, 2¾, 3, 3¼, 3½, 3¾, 4, 4¼, 4½, 4¾, 1, 1¼, 1½, 1¾, 6.0, 6.5 or about 7.0 inches in width or any width falling between these specific widths. Preferred are widths that are, about 3 to 5½ inches, about 3½ to 5 inches, about 3¾ to 4¾ inches in width, about 4 to 4½ inches in width, about 4½ to 4¼ inches and in one embodiment is about 4¼ inches in width.

Figure 8:
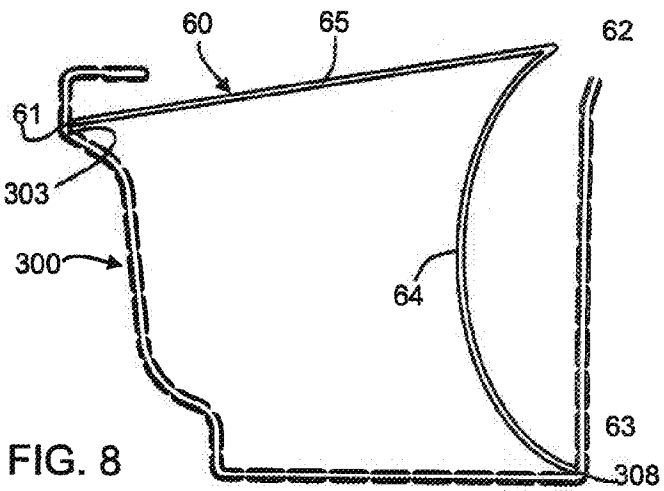
FIG. 8 is a side view of a gutter inset, half box, half round detent, in a K style rain gutter.

The vertical support member(s) 120, 130 need not be the same width, and they may be curved or straight and their total width anywhere from as wide as the inserts to as narrow as a ¼ of an inch. But in the preferred versions there is a set back in the vertical support members from the end of the insert from ⅛ to ¼ to ½ inch or so, usually 2 inches or less. The vertical support member could be made from a multiplicity of straight planes, if desired, thus resulting in a curve as shown in FIG. 8.

Another method of measuring the width of the upper blocking member 110 is to consider its width as a percent of the width of the gutter, from back wall to front lip. Here a solid or collapsible insert or form is described that is supported by walls of the gutter and where a portion of the insert covers from 160% to about 50% of the width of the gutter. Specifically, at least about 50%, 55%, 60%, 65%, 70%, 75%, 80%, 85%, 90%, 95%, 10%, 105%, 110%, 115%, 120% 125%, 130%, 135%, 140%, 145%, 150%, 155% or about 160% of the width of the gutter, is covered by the upper blocking member. The upper blocking member may be solid or have perforations or even be a screen to resist leaves and other debris from entering the gutter, but is should permeable enough to allow water from rain and other sources to enter the gutter.

Using the percent of gutter width method of measuring the width of the upper blocking member 110 in preferred embodiments it is, as measured as a percent of the width of the gutter, from back wall to front lip, it will, in various embodiments, cover from about 99%, 98%, 97%, 96%, 95%, 94%, 93%, 92%, 91%, 90%, 89%, 88%, 84%, 86%, 81%, 84%, 83%, 82%, 81%, 80%, 79%, 78%, 77, 76%, 75%, 74%, 73%, 72%, 71%, 70%, 69%, 68%, 67%, 66%, 65%, 64%, 63%, 62%, 61%, 60%, 59%, 58%, 57%, 56%, 55%, or about 50%, or any range of any of these percents, in increments of 1, 5 or 10 percent, of the width of the upper opening of the gutter trough, as measured over the width of the top or upper region of the gutter, from back wall to front lip. The uncovered part of the gutter trough, the gap or gutter gap, being on the side or edge of the insert closest to the house or building. Various embodiments are disclosed where the upper blocking member is from about 99 to 60, 98 to 70, 97 to 80, 96 to 85, 95 to 90, or any other range as a percent of the opening of the gutter trough, measured as a percent of width of the trough of the gutter when looking straight down into the gutter, or any range of any of the values described above.

Height. The vertical support member, in the half box style, may be such that it raises the upper blocking member any of the following distances from the bottom of the gutter: 2, 2¼, 2½, 2¾, 3, 3¼, 3½, 3¾, 4, 4¼, 4½, 4¾, 1, 1¼, 1½, 1¾, 5, 5¼, 5½, 5¾ or 6 inches above the bottom 304 of the gutter 300. Preferred is where the vertical support member is any of about 3 to 6 inches in height, about 3.25 to 5½ inches in height, about 3 to 5 inches in height, about 3.5 to 4½ inches in height, about 3.5 or about 4 inches in height. The height of the insert from top to bottom may be made from about 2 to 4 inches, it may be 2, 2¼, 2½, 2¾, 3, 3¼, 3½, 3¾, 4, 4¼, 4½, 4¾, 1, 1¼, 1½, 1¾, 6, 6¼, 6½, 6¾ or 4 inches, as measured from top to bottom (i.e. the height of the vertical support member).

Thickness. The thickness of the insert is between 0.001 and 0.50 inch. Embodiments are disclosed where it is rigid and not flexible and embodiments are disclosed where it is flexible. Specific thickness are provided as the following embodiments as examples.

Wherein the insert is comprised of plastic having the following thicknesses: Between about 0.001 and ½ inch, between about 0.001 and ¼ inch., between 0.050 and ⅛$^{th}$ inch., between about 0.005 and 0.200 inch between about 0.010 and 0.200 inch, between 0.010 and 0.10 inch. The thickness of the insert is between about 0.020 and 0.080 inch. The thickness of the insert is between about 0.030 and 0.070 inch. The thickness of the insert is between 0.040 and 0.060 inch. The thickness of the insert is between about 0.040 and 0.060 inch. The thickness of the insert is about 0.060 inch. The thickness of the insert is about 0.040 inch. The thickness of the insert is about 0.020 inch. The thickness of the insert is about 0.010 inch. Metal inserts will typically be thinner than plastic inserts. But this depends on the material used. One should be able to easily determine what materials and thickness work best depending on the preference of the installer and the preference of the end user.

Wherein the insert is comprised of metal having the following thicknesses: Between about 0.001 and ¼ inch, between about 0.005 and 0.10 inch, between about 0.050 and 0.090 inch. The thickness of the insert is between about 0.010 and 0.080 inch. The thickness of the insert is between about 0.010 and 0.070 inch. The thickness of the insert is between 0.02 and 0.060 inch. The thickness of the insert is between about 0.030 and 0.060 inch. The thickness of the insert is about 0.005 inch, 0.010 inch, 0.015, 0.020 inch, 0.025, or 0.030 inch or any range of thickness between any of these values. The thickness of the insert is about 0.019 or 0.020 inch. Metal inserts will typically be thinner than plastic inserts. But this depends on the material used. One should be able to easily determine what materials and thickness work best depending on the preference of the installer and the preference of the end user.

Gutter Gap.

In one embodiment the gutter insert has a gutter gap of from $1/10^{th}$ to 3 inches when in place in the gutter. Specific embodiments include the range from $1/10^{th}$ of an inch to 3 inches and include the following ranges and approximate gaps: from ⅛ to 2½ inch, ¼ to 2 inches, ⅜ to 1½ inches, ½ to 1½ inches, ¾ to 1 inch. Specific values are approximately ⅛, ¼, ⅜, ½, ⅝, ¾, ⅞, 1 inch, 1⅛, 1¼, 1½, 1⅜, 1½, 1,⅝, 1⅞, 2 inches, 2¼, 2¼, 2¾ and 3 inches in width.

The gap may also be measured in terms of percent of width of the gutter and using that system of measurement the gap may be 0, 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 35, 40 45 or 50% of the width of the gutter. Or any range or approximately of any specific percent mentioned. The gap is along the edge of the insert or side of the gutter against the building.

The Spring and Shied Type Insert.

The spring and shield type insert is made in two parts and assembled by the user, possibly in advance and alternatively it is made in place in a pre-existing gutter affixed to a house or building. The two parts consist of the "spring" or "deleted spring" that rests inside the gutter and the "shield" that attaches to and or rest against the spring. The shield can be solid or perforated. The shield can be a screen with small openings designed to keep larger bits of debris out of the gutter. The shield should mostly cover the gutter. Several designs are possible and shown in the drawings. The shield in one aspect rests on the bottom of the gutter in the front, i.e. the side away from the house and bends back toward the house or building side, resting against the spring. This orientation can be reversed. The shield in another aspect simply sits on top of the spring or deleted spring with or without being attached with fasteners.

In one aspect of the invention fasteners are used to attached the spring to the shield.

In one aspect the shield is attached to the spring or deleted spring with small hooks. In this aspect of the invention the spring is placed in the gutter, the shield is set on top of the spring and the small hooks in the shield grip the spring, keeping it firmly in place. The hooks could be small and randomly and numerously placed so they would engage the spring without the need for exact positioning. The spring would fill the gutter so the shield is held in optimal position covering the space of the gutter and keeping leaves and debris out of the gutter. Other inserts could be used to fasten the shield to the spring such as wire twisted in place, Velcro, or other fasteners, which could be made of any material.

The Table Type of Insert. In one embodiment the cover is shaped like a table with supports, posts or legs at the edges. The supports, legs or posts, which are also called vertical support members, have a bracing function whereby they support the top of the "table" herein called the upper blocking member. The vertical support units may be made of stiff or preferable made of flexible material. The upper blocking member like all upper blocking members described herein may be flat, domed or slanted from either back down to front or even from front down to back as needed for any particular gutter. The edges of the cover can be either inside the gutter or on top of the gutter, but the vertical support members will extend down into the gutter. Alternatively the upper blocking member can be about 1, 3, 5, 7, 9, 11, 12, 13, 15, 17, 19, 21, 23, 25, 27, 29, 31, 33, 35, 37, 39, 41, 43, or 45% of the width ofthe gutter. These percent widths can be applied to all the upper blocking members described herein.

Materials.

Any of the various types of inserts and in particular the box and half box types of inserts can be made out of the following materials. Examples of flexible materials are most types of plastics, metals, such as: aluminum, tin, copper, gold, nearly anything if made thinly can be flexible. It could be combined with other materials if desired. The flexible portion of the insert can be made of synthetic materials.

Plastic is the general common term for a wide range of synthetic or semi-synthetic organic solid materials suitable for the manufacture of industrial products. Plastics are typically polymers of high molecular weight, and may contain other substances to improve performance and/or reduce costs. Some important groups in these classifications are the acrylics, polyesters, silicones, polyurethanes, and halogenated plastics, polystyrene" (PS) and polyvinyl chloride (PVC). Other types of plastic are PET or PETE, polyethylene terephthalate: Commonly found on 2-liter soft drink bottles, water bottles, cooking oil bottles, peanut butter jars. HDPE, high-density polyethylene: Commonly found on detergent bottles, milk jugs. PVC, polyvinyl chloride: Commonly found on plastic pipes, outdoor furniture, siding, floor tiles, shower curtains, clamshell packaging. PP, polypropylene: Commonly found on bottle caps, drinking straws, yogurt containers, legos. PS, polystyrene: Commonly found on "packing peanuts", cups, plastic tableware, meat trays, take-away food clamshell containers.

Plastic in addition to the terms above includes all of the following: Polypropylene (PP), Polystyrene (PS), High impact polystyrene (HIPS), Acrylonitrile butadiene styrene (ABS), Polyethylene terephthalate (PET), Polyester (PES), Polyamides (PA), including Nylons and Nylon Fibers, Poly (vinyl chloride) (PVC), Polyurethanes (PU), Polycarbonate (PC), Polyvinylidene chloride (PVDC) (Saran), Polyethylene (PE), Polycarbonate/Acrylonitrile Butadiene Styrene (PC/ABS) which is a blend of PC and ABS that creates a stronger plastic.

Examples of trade names of these plastics are: Kevlar, Mylar, Lexan, and others. Some plastics are more suitable for use than others, depending on how the inserts are to be used, the properties desired and the length of use and exposure to the elements. One of ordinary skill in the art should be able to choose a suitable plastic. Some plastics will be naturally resistant to UV light, others will need UV blocking agents added to the inserts or coated on the outside upper blocking members 110, in order to prevent UV damage when such damage is a concern.

The inserts can also be made of natural fibers such as cotton, rayon, hemp etc. that may or may not be treated depending on the length of time it is expected to be used. In general natural fibers would not be expected to last as long as a metal foil or synthetic material and this may be preferred in some situations. Any or all of these materials could be used alone or combined with each other in any combination, depending in the interests of the installer and end user.

Installation and Securing the Insert in the Gutter

The insert fits either over or between the nails or bracket support used to attach the gutter to the house or building. The half box insert conveniently fits over the nails or brackets and under the roof overhang 700, see FIG. 4 The half box insert is gently squeezed compressing the upper blocking member towards the vertical support member, it is fitted into the gutter and released and the vertical support member is adjusted if necessary so that the lower edge of the vertical support members rests in the bottom of the gutter and its front edge fits into the 315 of the gutter. The insert can conveniently be made to any length desired. The upper blocking member 110 can be flat and sloped or it can have a rounded or domed or irregular shape to the upper blocking member 110. The preferred shape of the upper blocking member 110 is flat or sloping and usually will slope downward from building side or back edge 119, 219, down to front lip 315 to better keep most of the vegetation, i.e. leaves and other falling debris, usually of plant origin, out of the gutter; however in some situations, especially where the shingle dips down low into the gutter, the upper blocking member 110 may be level or may slope from its front edge 117, 217 that is higher than the back edge 119, 219, thus providing a upper blocking member 110 that slopes from front to back and where water would flow from the front edge 117, 217, over the back edge 119, 219 or to the house or building side of the upper blocking member 110, when the insert is placed in a rain gutter attached to a house or building. This reverse flow feature of the gutter inserts makes them especially unique and useful. The upper blocking member 110 can have holes to allow water to drain through, or the whole upper blocking member 110 can be permeable, for example a mesh screen or it can be solid as water will naturally drain down its edge and into the gutter.

The unique design of the inserts gives the half box design special advantages. Because of the gutter gap between the back wall 302 of the gutter 300 and the back edge 119, 219 of the insert 10 there is no possibility of water backing up into the house or building 600 attached to the gutter 300. This design also allows for easy compressibility and placement in the gutter as one simply pushes the bracing member at the bottom edge of the vertical support member into the bottom of the gutter, and preferably into the bottom back corner of the gutter, then the upper blocking member is pushed down into the gutter with its back edge going in first, under the roof and finally the front edge of the vertical support member is placed into the front lip of the gutter. When a compressive force is applied in a manner such that the upper blocking member 110 is squeezed towards the vertical support member 120, 130 such that the insert is compressed or squeezed together the insert can then be easily placed into the gutter while the gutter is attached to a house or building. Once the insert is compressed or squeezed together and pushed down into the gutter, past the overhang of the roof 700 shown in FIG. 4, it can then be allowed to expand back to its relaxed form and original shape and be positioned such that its front edge 117, 217, 217 is near the inside of the front lip 315 of the gutter 300 and the back edge 119, 219 of the insert 10 can then be put under the overhang 700 of the edge of the roof 700. This positioning of the insert prevents places it firmly into the gutter 300 in proper position where it can barely be seen from the ground. Finally as mentioned above, the unique design allows the insert to be placed into gutters where the shingle dips down low into the gutter, i.e. blow the top of the gutter. In this situation the upper blocking member 110 may be level or may slope from its front edge 117, 217 that is higher than the back edge 119, 219, thus providing a upper blocking member 110 that slopes from front to back and where water would flow from the front edge 117, 217, over the back edge 119, 219 or to the house or building side of the upper blocking member 110, when the insert is placed in a rain gutter attached to a house or building.

Usually the roof edge is an asphalt shingle that projects slightly over the edge of flashing on the edge of the roof. This projections creates an overhang above the trough of the gutter, FIG. 4. The shingles are made of a variety of materials, they are often asphalt but they can also be made of slate, copper, tin, metal alloy, fiberglass or some other water resistant material. The insert can be compatible both physically and by appearance to any roofing or gutter materials. Gutters are commonly made of resin or metal materials like aluminum, zinc, copper or some alloy. The inserts described herein avoid common installation problems because they require no touching of the roof or shingles and then need no fasteners of any kind. They may be installed before or after the gutters are attached to the house or building. The gutter insert stays in place because there is little wind directed down into the gutter and what wind does hit or affect the inserts tends to push it in place rather than lift it out. The top of the cover can be either smaller than, and according to the percentages described herein or it can be slightly larger than the top of the gutter and the upper blocking member can be made of any material, foil, plastic, screen or mesh that fits in or over the gutter to prevent non-liquids from entering the gutter.

Composition and Materials

The insert is preferably made of any durable material, the collapsible form most easily from wire and fabric, or even wire alone if fairly densely woven. The weave should be tight enough to keep small leaves from penetrating the top. Typically it should be made of relatively strong durable material because it will be exposed to the sun and elements. Most metals are suitable. Because of its low cost and rust inhibiting qualities aluminum is an excellent material. Galvanized steel works. If plastic, acrylic works well, so does polyethylene. The inserts can also be made of disposable materials for temporary use or made out of biodegradable or even water soluble materials for special temporary applications. When used in climates with snow and ice it should be strong enough to resist the pressure of the snow and ice that may form on the roof and slide onto the insert. If fabric is used, the fabric should be UV resistant or made UV resistant as it will typically be exposed to the sun.

One preferred method of making and using the inserts is to use aluminum, optionally painted or coated, of about 0.020 inches thick, as an example, and make the insets a convenient length, e.g. 18 inches, or 36 inches and then every 4½ inches cut a vertical support member that is about 3¼ inch long, then simply cut, or stamp out each piece, with the dimensions mentioned 2 pieces can be cut from a strip of Al that is about 14 or 15 inches wide, and no material is wasted. Following cutting the piece is passed to a bending device like a metal brake, that makes the bends, resulting in a final product as shown in many of the figures.

The insert can be made of a material that can be painted and if desired, painted to any color, include a color to match the color of the gutter or the house or building where it is used. Some prefer a dark or black color thinking it hides the insert, others prefer a light color to blend in with the typical gutter which is often white. Any type of lights, including Christmas lights could be attached to it, or it could include tabs or hooks to allow for easy attachment of lights or other decorative objects.

Sectional Aspects

The insert can easily be installed in sections. The sections can easily be removed for cleaning or replacement as needed or desired. If the style used is collapsible, the removed sections and be collapsed and saved or discarded as desired. If a fixed "box" style of insert is preferred the "boxes" can be made to stack. If the box style is used the boxes can be made of any material including any type of plastic, preferable with UV inhibitor or any other preferable durable material like tin or aluminum. The boxes can be closed in the shape of the tube or tunnel or in a circle shape or in a shape of the letter "U." The U shape can be easily stacked.

Roof and Shingle Installation Aspects

Usually the roof edge is an asphalt shingle 700 that ends with an overhang 700 somewhere over the gutter 300, see FIG. 4. The shingle on the roof 700 can be made of any material, it is often asphalt but can also be made of slate, copper, tile or other waterproof materials. The insert 10 is compatible both physically and by appearance to any of these roofing materials and to any gutter materials. Gutters are commonly made of aluminum, zinc or copper. The inserts described here avoids common installation problems by either being installed before the gutter is installed (typically box or "U" style) or if the gutter is already installed and in place, the collapsible form, or half box style of the insert is used which allows easy installation. The insert stays in place because there is little wind that is directed down into the gutter and what wind there is actually acts to keep the insert in place rather than lift it out. If additional securing of the insert is needed it can be accomplished by fitting it snugly to the gutter and or securing the insert to the nails or brackets which hold the gutter to the house or building.

The top of the insert can be slightly larger than the top of the gutter and with a foil or fabric lip that fits over the gutter to prevent wet leaves from sliding over the tube and into the gutter. The foil lip need not be large and can be painted the same color as the gutter. In alternative embodiments the top of the insert is called an upper blocking member and it can be smaller than or not a wide as the width of the gutter, it fits into the front lip 315 of the gutter and it has a gap near the back wall of the gutter which is the side closest to the building when the gutter is installed. The insert can be fashioned so the gap is of various sizes and dimensions mentioned above.

Methods of Manufacture

The inserts described herein can be manufactured by a variety of methods. They and be cut from a sheet of material either by stamping, roller cutting, router cutting, laser cutting or any other cutting method, preferably computer controlled for precision cuts. After cutting the pieces can be smoother or polished, bent or shaped into proper position, from either hot or cold bending, and painted or coated by a variety of procedures if desired. Powder coating makes for a nice finish and can be done in a variety of colors. Alternatively various injection molding techniques could be used, such as extrusion with final shaping and or cutting if needed. Alternatively the inserts can be made by computer controlled shaping or any number of other processes.

Numbered Description of the Invention

1. A gutter insert comprising at least one an upper blocking member and at least one vertical support member. 2. A gutter insert of number 1, the vertical support member being flexibly attached to the proximal or back edge of the upper blocking member and the proximal or upper edge of said vertical support member and having a bracing member on its lower edge. 3. A gutter insert of number 2, the bracing member being made of water resistant material. 4. A gutter insert of number 3, the bracing member bottom end that is no wider than 25 percent of the width of the gutter the gutter insert is designed to fit into, and wherein the upper blocking member is not fully engaged over its entire length with the vertical support member.

5. A gutter insert of number 4 where the bottom of the bracing member is no wider than 1.0 inch. or more than 10 percent of the gutter the gutter insert is used in. 6. A gutter insert of number 4 where the bottom of the bracing member is no wider than 5 percent of the gutter the gutter insert is designed to fit into, and wherein the upper blocking member is not engaged with the vertical support member on either end having at least 1 inch where the upper blocking member is not engaged with the vertical support member. 7. A gutter insert comprising at least one an upper blocking member, at least one vertical support member, wherein the upper blocking member has a width, measured from front edge to back edge, of at least one inch and no more than 10 inches, herein the upper blocking member and vertical support member are attached to each other along the distal edge of the upper blocking member and the proximal edge of the vertical support member, wherein the vertical support member has a distal edge that is a bracing member, wherein the upper blocking member and vertical support member are flexibly engaged with each other, wherein the length of the insert is greater than its width. 8. The gutter insert of number 7 wherein, when viewed from a side view, the upper blocking member and the vertical support member form an angle of separation, wherein the angle is greater than 30 degrees and less than 90 degrees. 9. The gutter insert of number 8 wherein the length of the insert is greater than 8 and less than 10 inches, wherein the upper blocking member and vertical support member are engaged at an angle of 90 degrees or less and more than 40 degrees, wherein the width of the upper blocking member is between 2 and 7 inches, wherein the height of the vertical support member is between 2 to 8 inches, wherein the vertical support member is not engaged with the upper blocking member over its entire length, wherein the thickness of the upper blocking member and the lower end of the vertical support member is between 0.001 and 0.5 inch thick, wherein the vertical support member is flexible.

10. The gutter insert of number 9 wherein the length of the insert is greater than 10 and less than 90 inches, wherein the upper blocking member and vertical support member are engaged at an angle of 80 degrees or less and more than 40 degrees, wherein the width of the upper blocking member is between 2 and 5 inches, wherein the height of the vertical support member is from 2 to 6 inches, wherein the vertical support member is not engaged with the upper blocking member over its entire length, wherein the thickness of the materials used in the manufacture of the various members of the insert is between 0.010 and 0.25 inch, wherein the vertical support member is flexible. 11. An insert of number 10 wherein the thickness of the insert is between about 0.050 and 0.090 inch, or between about 0.010 and 0.080 inch, or between about 0.010 and 0.070 inch, or between 0.010 and 0.060 inch, or between about 0.010 and 0.050 inch or between about 0.010 and 0.040 inch, or between about 0.015 and 0.030 inch or about 0.020 inch. 12. An insert of above with a flexible vertical support member having a bend or a detent. 13. A gutter insert for impeding the egress of non-liquid debris into a gutter, the gutter including a front wall terminating into a front lip, a back wall, and a bottom wall, the bottom wall extending between and connecting the front wall to the back wall, wherein the gutter inset comprises: a) a blocking member including means for engaging the gutter front lip, and b) a generally vertical support member connected to the blocking member, the generally vertical support member including means for engaging the insert with the gutter at a location on or near the lower one half, one third, or bottom wall of the gutter. 14. A gutter insert of number 13 where the generally vertical support member of the insert engages the gutter with the inside bottom wall of the gutter.

15. A gutter insert of number 14 where the generally vertical support member of the insert engages the gutter at the inside of the gutter at a location on or near the inside gutter corner where the bottom wall of the gutter connects to the back wall of the gutter. 16 A gutter insert of number 15 where there are a multiplicity of vertical support members engaging one or more upper blocking members. 17. A gutter insert of number 16 where there are a multiplicity of vertical support members engaging one upper blocking member. 18. A gutter insert of number 17 where there are 1 to 8 vertical support members engaging one upper blocking member. 19. A gutter insert of number 18 where the vertical support members are from 3 to 7 inches in length, and the upper blocking member is from 3 to 6 inches in width.

20. A gutter insert described herein where the upper blocking member is slanted from back to front, higher in the back and lower in the front and or wherein the upper blocking member has a front edge that rests in or on the front lip of the gutter. 21. Use of a gutter insert to keep rain gutters free of non liquid debris draining freely without clogging comprising a gutter insert having: a) an upper blocking member and at least one vertical support member, b) wherein the upper blocking member is comprised of a flat or rounded structure with its distal edge engaged with the vertical support member, c) wherein either one or both the upper locking member and the vertical support member may be divided into a multiplicity of pieces, d) wherein the distal portion of the upper blocking member and the proximal portion of the vertical support member are attached to each other, e) wherein the upper blocking member and the vertical support member are attached to one another such that they form an angle, when viewed from the end, such that the angle is less than 90 degrees. 22. Use of a gutter insert of number 21 wherein: a) the length of the insert is greater than 5 inches, b) the width of the horizontal blocking member is between 2 and 7 inches, c) the height of the vertical support member is from 2 to 6 inches, d) the vertical support member is not engaged with the horizontal blocking member over its entire length, e) the thickness of the insert is between 0.001 and 0.500 inch, wherein the vertical support member(s) are flexible. 23. Use of an insert of an insert of number 22 wherein the horizontal blocking member has a surface that, when in position in a gutter, slopes either upward or downward with its proximal edge joined to the vertical support member and having its distal edge engaged with the lip of a gutter. 24. Use of an insert of number 23 wherein the upper blocking member is between about 3 to 5½ inches in width, between about 3½ to 5 inches in width, between about 3¾ to 4¾ inches in width, between about 4-4½ inches in width, is about 4¼ inches in width.

25. Use of an insert of number 24 wherein the vertical support member is about 3¾ to 5¾ inches in height, about 4 to 5½ inches in height, between about 4¼ to 5¼ inches in height, between about 4½ to 5 inches in height, about 4¾ inches in height. 26. Placing a rain gutter insert into a rain gutter, the insert having an upper blocking member which is engaged with at least one vertical support members having a bracing member at the bottom of the vertical support member, wherein the width of the upper blocking member is the same or less than the width of the gutter trough in which it is placed, wherein the insert has a length greater than its width, wherein the upper blocking member has a proximal edge that is parallel with its distal edge, wherein the upper blocking member is engaged at various intervals, at its distal or back edge with the proximal or upper edge of the vertical support members, wherein the vertical support members have a proximal or upper edge that engages with the distal or back edge of the upper blocking member, wherein the vertical support member has a distal or bottom edge that is parallel with both its proximal edge and with the distal and proximal edges of the upper blocking member, wherein the insert has a thickness that is less than 0.5 inch, wherein the distal or bottom edge of the vertical support member engages the back wall or bottom wall of a gutter, whereby the insert is placed into the gutter by first placing the bracing member into the gutter, then compressing and folding the vertical support member such that the upper bracing member is folded under the edge of the roof or shingles which extend beyond the wall of the house the gutter is fastened to, and then folding the vertical support member down such that it rests in on or near the front upper lip of the gutter. 27. Placing the gutter insert of number 27, wherein the vertical support member extends to the bottom of the gutter. 28. The gutter insert of number 27 wherein the vertical support member rests against the bottom corner of the gutter. 29. The gutter insert of number 28 wherein the vertical support member extends to the bottom wall of the gutter and rests against the back corner wall of the gutter.

30. The gutter insert described herein wherein the upper blocking member has a width that covers less than 140% of the width of the gutter and in alternative embodiments only about 99% of the width of the gutter is covered, with the uncovered part of the gutter trough being closest to the house or building side of the gutter. In various embodiments, about 98%, or about 94%, 96%, 91%, 94%, 93%, 92%, 91%, 90%, 89%, 88%, 84%, 86%, 81%, 84%, 83%, 82%, 81%, 80%, 79%, 78%, 77, 76%, 75%, 74%, 73%, 72%, 71%, 70%, 69%, 68%, 67%, 66%, 65%, 64%, 63%, 62%, 61%, 60%, 59%, 58%, 57%, 56%, 55%, or about 50%, or any range of any of these percents of the gutter trough, as measured over the width of the gutter, front to back or back to front, is covered by the insert. 31. The gutter insert described herein wherein the uncovered part of the gutter trough is the side closest to the house or building. 32. The gutter insert described herein wherein the vertical support member is attached to the edge of the upper blocking member and the vertical support member extends from the upper blocking member down into the gutter and is supported by having the lower edge of the vertical support member rest against the back wall, bottom wall, or the vertical support member has its lower edge resting against the bottom corner of the gutter, the corner closest to the house. 33. The gutter insert described herein wherein the vertical support member consists of one or a multiplicity of attached, detent or bent elements that extends from the upper blocking member to the inside of the gutter. 34. An article of manufacture comprising a metal or plastic insert used to keep rain gutters open and draining freely without clogging from falling leaves comprising: an upper blocking member and at least one vertical support member, wherein the upper blocking member is comprised of a flat or rounded structure with its distal edge engaged with the vertical support member, wherein either or both the upper blocking member and the vertical support member may be divided into a multiplicity of pieces, wherein the distal portion of the upper blocking member and the proximal portion of the vertical support member are attached to each other, wherein the upper blocking member and vertical support member are attached such that they form an angle such that the plane of the upper blocking member is at an angle of less than 90 degrees and more than about 40 degrees when measured with the plane of the vertical support member, wherein the length of the insert is greater than 5 inches, wherein the width of the horizontal blocking member is between 2 and 7 inches, wherein the height of the vertical support member is from 2 to 6 inches, wherein the vertical support member is not engaged with the horizontal blocking member over its entire length, wherein the thickness of the article is between 0.001 and 0.5 inch, wherein the vertical support member(s) are flexible.

35. An article of number 34 where the thickness of the article is between 0.005 and 0.200 inch or between 0.010 and 0.10 inch, or between 0.010 and 0.080 inch, or between 0.040 and 0.060 inch, or between 0.015 and 0.040 inch, or between 0.0.10 and 0.30 inch or is 0.020 inch. 36. An article of manufacture comprising a gutter insert with a upper blocking member, at least one vertical support member, wherein the upper blocking member has a width, measured from edge to edge, of at least one inch and no more than 10 inches, wherein the upper blocking member and vertical support member are attached to each other along the distal edge of the upper blocking member and the proximal edge of the vertical support member, wherein the upper blocking member and vertical support member are engaged at an angle such that the planes of the two members create an angle of less than 10 degrees and more than 20 degrees, wherein the length of the insert is greater than its width. 37. An article of manufacture of number 35 where the range of the angles formed by the angle X has any of the following ranges or numbers exactly or approximately, 20-110, 20-10, 30-10, 20-90, 30-90, 40,-90, 80, 40-80, 50-90, 50-80, 60-90, 60-80, 70-90, 70-80, 80-90, degrees of angle. Specifically 45, 50, 55, 60, 65, 70, 75, 80, 85, More precisely 75, 76, 77, 78, 79, 80, 81, 82, 83, 84, or 85 degrees or degrees of angle. The X angle is shown in FIG. 4. 38. An article of manufacture of number 35 where the range of the angles formed by the angle Y has any of the following ranges or numbers exactly or approximately, 0, zero degrees (or 180 degrees depending on the perspective), that is, no appreciable angle or detent in any part of the vertical support member 120, including the bracing members 113, 118 or it can be anywhere between 180 (no angle) and 20 degrees. The angle Y is most often about 180, 170, 160, 150, or more degrees, with the optimal angle being about 180, 170 or 160 degrees as shown by the "Y" angle in FIG. 4. Specifically this angle Y is most often between 160 and 180, between 150 and 170, between 140 and 160, between 50 and 150, between 60 and 180, between 180 and 170, between 180 and 150, or on or about 120, 125, 130, 135, 140, 145, 150, 160, 165, 170, 175 or 180 degrees of an angle, or any range between any two of these numbers. 39. The process of making any of the gutter inserts described in the specification or claims. 40. The use of any of the gutter inserts described in the specification or claims for the purpose of keeping falling vegetable matter out of the rain gutter it is used in and for which it promotes the flow of rain water down the gutter.

Other Embodiments

While the invention has been described in conjunction with the detailed description above, that description is intended to illustrate and not limit the scope of the invention, which is defined by the scope of the claims. Other aspects, advantages, and modifications are within the scope of the following claims.

All publications and patents referred to in this disclosure are incorporated herein by reference to the same extent as if each individual publication or patent application were specifically and individually indicated to be incorporated by reference. Should the meaning of the terms in any of the patents or publications incorporated by reference conflict with the meaning of the terms used in this disclosure, the meaning of the terms in this disclosure are intended to be controlling. Furthermore, the foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

The invention claimed is:

1. A gutter insert comprising one upper blocking member and at least one vertical support member, wherein said vertical support member, has an upper part and a lower part, wherein said upper blocking member is not engaged with the vertical support member over the full length of the upper blocking member, wherein said upper blocking member is flexibly engaged with said at least one vertical support member; along the upper block member defining connected portions and open portions, wherein there is a gap of at least ⅛th inch between edges connected portions blocking member and back wall of the gutter when the insert is placed in a gutter, wherein said vertical support member has a detent between said upper and lower parts thereof, wherein said lower of the vertical support member is a bracing member which rests against the bottom of the gutter when in use, wherein said angle between the upper part of the vertical support member and the lower part of the vertical support member is less than 180 degrees but greater than 90 degrees.

2. A gutter insert of claim 1, wherein said gap is between ⅛ to 2 inches.

3. A gutter insert of claim 2, wherein said upper blocking member has a set back which extends said upper blocking member beyond the point where it joins with the vertical support member.

4. A gutter insert of claim 3, wherein said upper blocking member is flexibly engaged with the end of two or more vertical support members.

5. A gutter insert of claim 4, wherein said upper blocking member is between about 3 to 7 inches wide and said vertical support member is between about 3 to 7 inches in height, and wherein said set back is ¼ or more inch in length.

6. A gutter insert of claim 5, wherein the angle between the upper part of the vertical support member and the lower part is between about 170 and 140 degrees.

7. A gutter insert of claim 6, wherein said gap is between ¼ to 1-½ inches.

8. A gutter insert comprising a single upper blocking member and at least two vertical support members, wherein said vertical support members are attached to said single upper blocking member, wherein said upper blocking member is not engaged with said vertical support members over the full length of the upper blocking member, wherein said upper blocking member is flexibly engaged with the proximal end of the vertical support members, wherein there is a gap of at least ¼$^{th}$ inch and less than 1 ½ inches between the distal edge of the upper blocking member and back wall of the gutter when the insert is placed in said gutter, wherein said vertical support members have an upper part and a lower part, with a detent between said upper part and said lower part, wherein said lower part of the vertical support member is a bracing member which rests against the bottom of the gutter when in use, wherein there is an angle of about 140 and 170 degrees between the upper part of the vertical support member and the lower part of the vertical support member.

* * * * *